US006978549B2

(12) United States Patent
Ellis

(10) Patent No.: US 6,978,549 B2
(45) Date of Patent: Dec. 27, 2005

(54) PATTERNING SYSTEM FOR A SELECTED BODY TYPE AND METHODS OF MEASURING FOR A SELECTED BODY TYPE

(76) Inventor: Stacey L. Ellis, 278 Warburton Ave., 3rd Fl., Yonkers, NY (US) 10701

( * ) Notice: Subject to any disclaimer, the term of this patent is extended or adjusted under 35 U.S.C. 154(b) by 0 days.

(21) Appl. No.: 10/162,934

(22) Filed: Jun. 5, 2002

(65) Prior Publication Data

US 2003/0226266 A1 Dec. 11, 2003

(51) Int. Cl.[7] ..... A41H 3/00
(52) U.S. Cl. ..... 33/17 R; 33/17 A; 33/2 R; 33/12; 33/1 C; 33/512
(58) Field of Search ..... 33/17 R, 17 A, 33/2 R, 11–12, 1 B, 1 C, 1 AA, 1 BB, 512, 33/679.1

(56) References Cited

U.S. PATENT DOCUMENTS

| | | | | | |
|---|---|---|---|---|---|
| 3,525,458 | A | | 8/1970 | Mason | |
| 3,734,362 | A | | 5/1973 | Arthur | |
| 3,907,107 | A | | 9/1975 | Vercollone | |
| 3,911,584 | A | * | 10/1975 | Ajus et al. | 33/11 |
| 3,939,565 | A | | 2/1976 | Bush | |
| 4,137,634 | A | * | 2/1979 | Klamar | 33/12 |
| 4,780,960 | A | * | 11/1988 | Merz | 33/17 R |
| 4,894,919 | A | * | 1/1990 | Ziegert | 33/17 R |
| 4,995,514 | A | * | 2/1991 | Forschner | 206/574 |
| 5,014,364 | A | | 5/1991 | Orr | |
| 5,031,326 | A | * | 7/1991 | Huang | 33/17 R |
| 5,372,141 | A | * | 12/1994 | Gallup et al. | 600/547 |
| 5,566,867 | A | | 10/1996 | Goray | |
| 5,570,533 | A | * | 11/1996 | Vouyouka | 33/17 A |
| 5,615,318 | A | | 3/1997 | Matsuura | |
| D444,818 | S | | 7/2001 | Fullalove | |
| 6,311,403 | B1 | * | 11/2001 | Macrini | 33/1 SD |
| 6,415,199 | B1 | * | 7/2002 | Liebermann | 700/132 |
| 6,507,309 | B2 | * | 1/2003 | McMakin et al. | 342/22 |
| 6,539,636 | B1 | * | 4/2003 | Jennings | 33/11 |
| 2002/0004763 | A1 | * | 1/2002 | Lam | 705/26 |
| 2003/0065525 | A1 | * | 4/2003 | Giacchetti et al. | 705/1 |
| 2004/0054752 | A1 | * | 3/2004 | Takagi et al. | 709/217 |
| 2004/0083142 | A1 | * | 4/2004 | Kozzinn | 705/27 |

* cited by examiner

*Primary Examiner*—Christopher W. Fulton
*Assistant Examiner*—Yaritza Guadalupe

(57) ABSTRACT

The present invention provides a patterning system and method thereof for a specific Black human selected body physique type and gender when combining and correlatively assembling a body part location(s), height measurement, a weight and an a Black ethnicity solution(s) for the specific Black selected body type, to form a patterning system that is recorded on a patterning surface and to create standard sizing guide and system for the Black human body physique.

20 Claims, 28 Drawing Sheets

*FIG. 3*

Figure 1A:
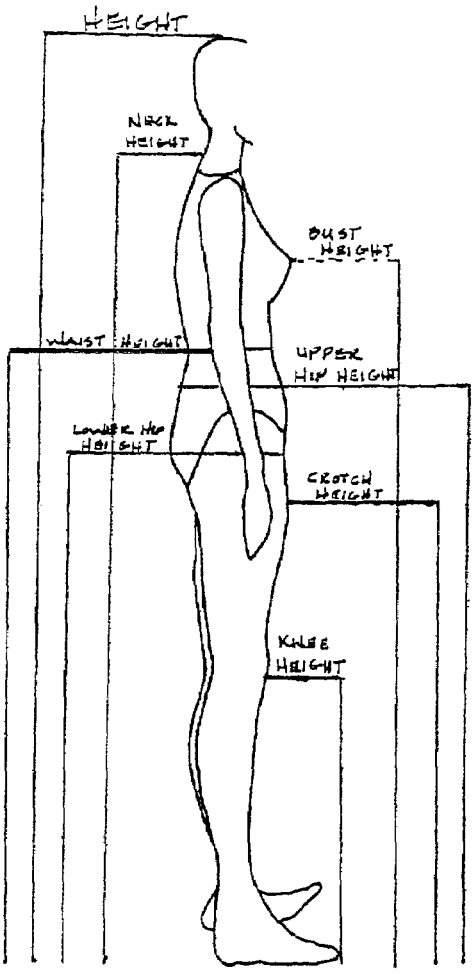

WOMEN'S BODY MEASUREMENT RATIOS: DIFFERENCE BETWEEN THE BLACK BODY TYPE RATIOS AND THE INDUSTRY- STANDARD BODY TYPE SIZING RATIOS*

| BUST | | | WAIST | | | HIP | | |
|---|---|---|---|---|---|---|---|---|
| BBT (x) | IS | Difference | BBT (.80x) | IS | Difference | BBT (1.10x) | IS | Difference |
| 31.5 | N/A | N/A | 25.2 | N/A | N/A | 34.65 | N/A | N/A |
| 32.5 | 28.5 | 4 | 26 | 21 | 5 | 35.75 | 30.5 | 5.25 |
| 33.5 | 29.5 | 4 | 26.8 | 22 | 4.8 | 36.85 | 31.5 | 5.35 |
| 34.5 | 30.5 | 4 | 27.6 | 23 | 4.6 | 37.95 | 32.5 | 5.45 |
| 35.5 | 31.5 | 4 | 28.4 | 24 | 4.4 | 39.05 | 33.5 | 5.55 |
| 36.5 | 32.5 | 4 | 29.2 | 25 | 4.2 | 40.15 | 34.5 | 5.65 |
| 38.5 | 34 | 4.5 | 30.8 | 26.5 | 4.3 | 42.35 | 36 | 6.35 |
| 39.5 | 36 | 3.5 | 31.6 | 28 | 3.6 | 43.45 | 38 | 5.45 |
| 40.5 | 38 | 2.5 | 32.4 | 30 | 2.4 | 44.55 | 40 | 4.55 |

BBT = Black Body Type Standard
IS = Industry-Standard Measurements

* All body measurements are in inches. The measurements have a tollerable range : x plus or minus .10.

*FIG. 4*

MEN'S BODY MEASUREMENT RATIOS: DIFFERENCE BETWEEN THE BLACK BODY TYPE RATIOS AND THE INDUSTRY- STANDARD BODY TYPE SIZING RATIOS*

| CHEST | | | WAIST | | | HIP | | |
|---|---|---|---|---|---|---|---|---|
| BBT (x) | IS | Difference | BBT (.80x) | IS | Difference | BBT (1.01x) | IS | Difference |
| 38 | 38 | 0 | 30.4 | 32.3 | 1.9 | 38.38 | 38.46 | 0.76 |
| 39 | 39 | 0 | 31.2 | 33.15 | 1.95 | 39.39 | 39.47 | 0.78 |
| 40 | 40 | 0 | 32 | 34 | 2 | 40.4 | 40.48 | 0.8 |
| 41 | 41 | 0 | 32.8 | 34.85 | 2.05 | 41.41 | 41.49 | 0.82 |
| 42 | 42 | 0 | 33.6 | 35.7 | 0 | 42.42 | 42.5 | 42.5 |
| 43 | 43 | 0 | 34.4 | 36.55 | 0.2 | 43.43 | 43.52 | 1.94 |
| 44 | 44 | 0 | 35.2 | 37.4 | .6/.4 | 44.44 | 44.53 | 1.95 |
| 45 | 45 | 0 | 36 | 38.25 | 0.4 | 45.45 | 45.54 | 2.96/2.46 |
| 46 | 46 | 0 | 36.8 | 39.1 | 0.2 | 46.46 | 46.55 | 2.97 |
| 47 | 47 | 0 | 37.6 | 39.95 | 1 | 47.47 | 47.56 | 3.48 |

BBT = Black Body Type Standard
IS= Industry-Standard Measurements

* All body measurements are in inches. The measurements have a tollerable range: x plus or minus 0.10.

*FIG. 5*

| | Female: Percentage of Total Height Ratios | | | Male: Percentage of Total Height Ratios | | |
|---|---|---|---|---|---|---|
| | Black Body Type | Industry Standard | Difference | Black Body Type | Industry Standard | Difference |
| **Front waist height**: length from floor to true waist | 57% | 60% | 3% | 55% | 56% | 1% |
| **Top/Apex of head to center front waist**: length from top of head to true waist | 43% | 40% | 3% | 45% | 47% | 2% |
| **Side waist height**: length from floor to true waist | 60% | 63% | 3% | 58% | 56% | 2% |
| **Side hip height**: length from floor to the waist along the side or profile of the body | 52% | 52% | 0% | 50% | 48% | 2% |
| **Side waist to side hip**: length from true waist to hip along the side or profile of body | 8% | 11% | 3% | 7% | 8% | 1% |
| **Side waist to side bottom of gluteus**: length from true waist to gluteus along side or profile | 14% | 17% | 3% | 12% | 11% | 1% |
| **Back waist height**: length from center back (true) waist to floor | 62% | 62% | 0% | 60% | 57% | 3% |
| **Top/Apex of head to center back waist**: length from top of head to true waist | 38% | 38% | 0% | 40% | 42% | 2% |
| **Gluteus Curve**: length from bottom of back waist, down and over the natural curve of the gluteus to the beginning of back thigh | 19% | 16% | 3% | 16% | 13% | 3% |
| **Height of back leg**: length of leg from the bottom of gluteus to floor | 48% | 45% | 3% | 47% | 44% | 3% |

*FIG. 6*

Women's Finished Garment Measurement Ratios

| FRONT RISE* | | | BACK RISE** | | |
|---|---|---|---|---|---|
| Black Body Type | Industry Standard | Difference | Black Body Type | Industry Standard | Difference |
| 6.375" | 14.5" | 8.125 | 9.125" | 12.625" | 3.5 |
| 6.625" | 15" | 8.375 | 9.5" | 13.0" | 3.5 |
| 6.875" | 15.5" | 8.625 | 9.875" | 13.375" | 3.5 |
| 7.25" | 15.875" | 8.625 | 10.25" | 13.75" | 3.5 |
| 7.625" | 16.25" | 8.625 | 10.625" | 14.125" | 3.5 |
| 8" | 16.625" | 8.625 | 11" | 14.5" | 3.5 |
| 8.375" | 17" | 8.625 | 11.375" | 14.875" | 3.5 |

*Rise* is defined as the length from the center front waist line, down between and or through the legs , following the body's natural curve, to the waist line at the center back.
*FRONT RISE refers to the length from the center front waist line, down to the end of the front crotch (where front pant meets back pant).
**BACK RISE refers to the length from the center back waist line, down through/ the legs, around the natural curve of the gluteus, to the point of where to back pant meets the front pant.

*FIG. 7*

Men's Finished Garment Measurement Ratios

| FRONT RISE* | | | BACK RISE** | | |
|---|---|---|---|---|---|
| Black Body Type | Industry Standard | Difference | Black Body Type | Industry Standard | Difference |
| 10.25" | 14.75" | 4.5 | 8.875" | 12.125" | 3.25 |
| 10.625" | 15.125" | 4.5 | 9.25" | 12.5" | 3.25 |
| 11" | 15.5" | 4.5 | 9.625" | 12.875" | 3.25 |
| 11.375" | 15.875" | 4.5 | 10" | 13.25" | 3.25 |
| 11.75" | 16.25" | 4.5 | 10.375" | 13.625" | 3.25 |
| 12.125" | 16.625" | 4.5 | 10.75" | 14" | 3.25 |
| 12.5" | 17" | 4.5 | 11.125" | 14.375" | 3.25 |
| 12.875" | 17.375" | 4.5 | 11.5" | 14.75" | 3.25 |

*Rise* is defined as the length from the center front waist line, down between and or through the legs , following the body's natural curve, to the waist line at the center back.

*FRONT RISE refers to the length from the center front waist line, down to the end of the front crotch (where front pant meets back pant).

**BACK RISE refers to the length from the center back waist line, down through/ the legs, around the natural curve of the gluteus, to the point of where to back pant meets the front pant.

FIG. 10a1

FIG. 11a1
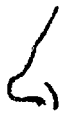
FIG. 11a2
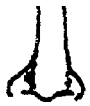
FIG. 11b1
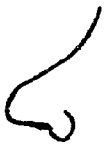
FIG. 11b2
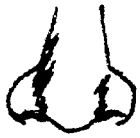
FIG. 12a
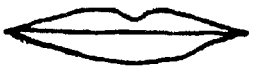
FIG. 12b
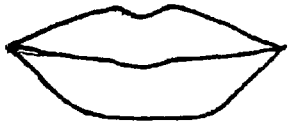

FIG. 16a1 FIG. 16a2
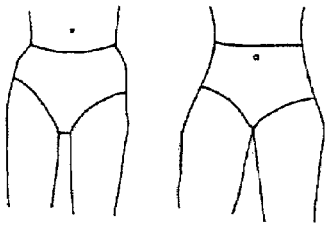
FIG. 16b1 FIG. 16b2
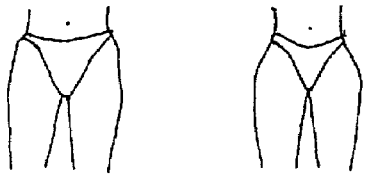
FIG. 17a1 FIG. 17a2
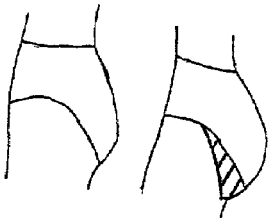
▨ - Section of buttock on the black body type exposed in an industry-standard underpant
FIG. 17b1 FIG. 17b2
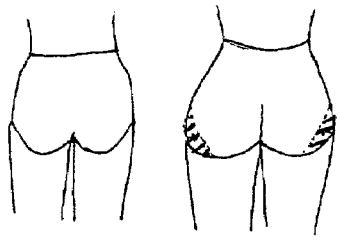
▨ - Section of buttock on the black body type exposed in an industry-standard underpant
FIG. 18a
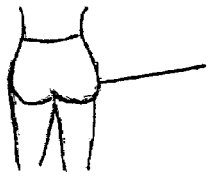
1735
FIG. 18b
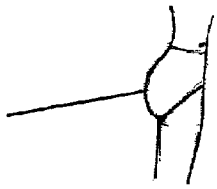

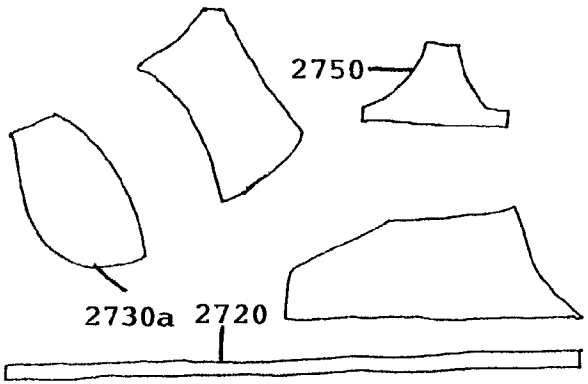
FIG. 27a2
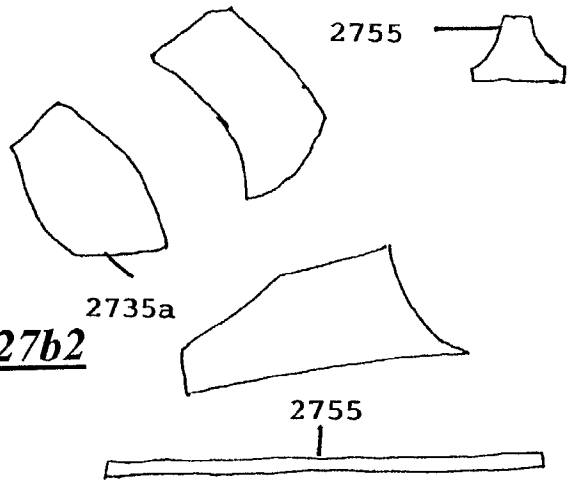
FIG. 27b2
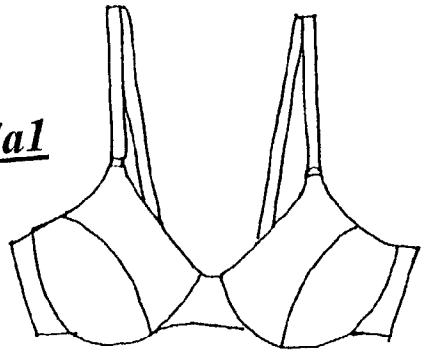
FIG. 27a1
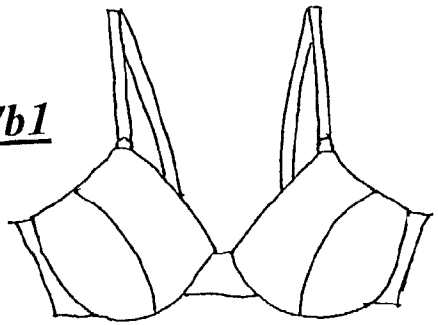
FIG. 27b1

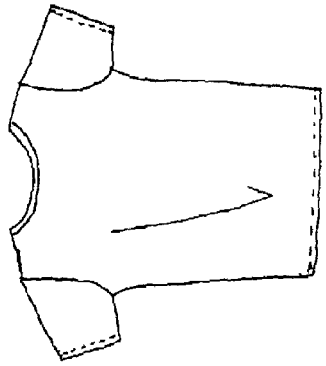
FIG. 28b2
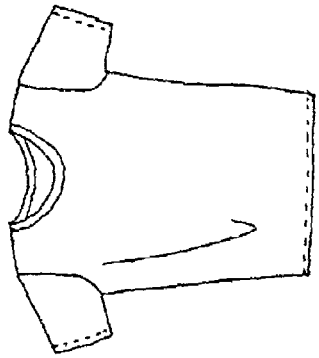
FIG. 28b1
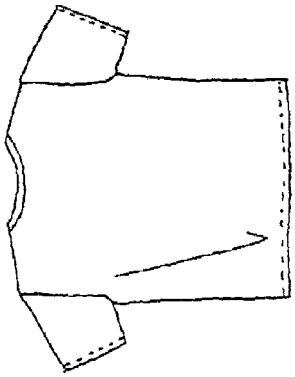
FIG. 28a2
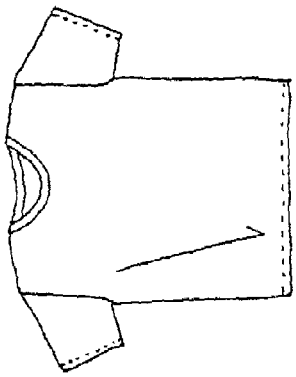
FIG. 28a1
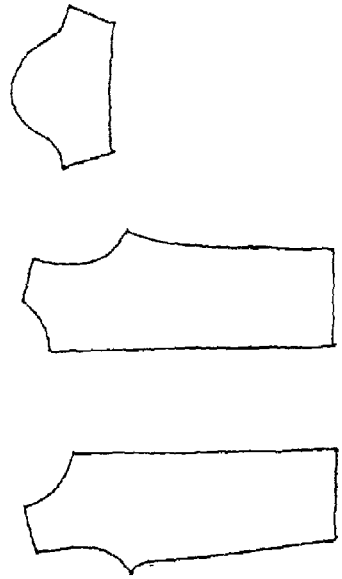
FIG. 28b3
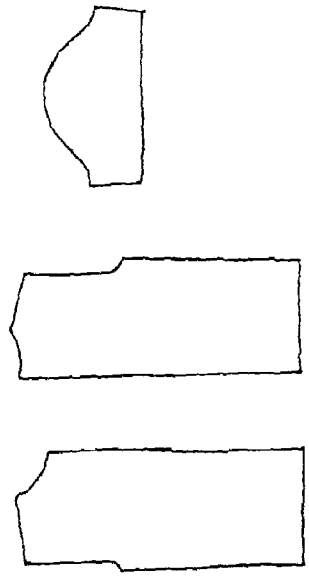
FIG. 28a3

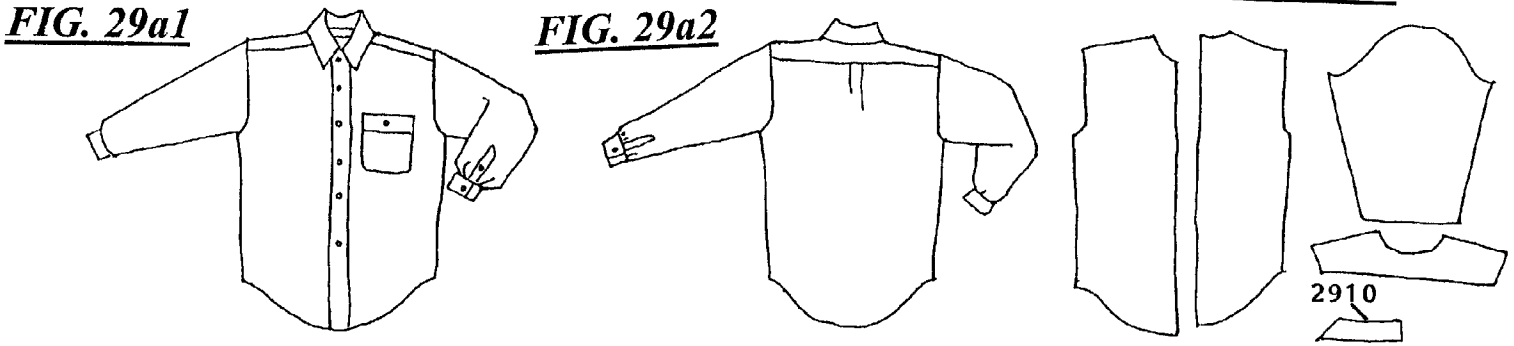
FIG. 29a1
FIG. 29a2
FIG. 29a3
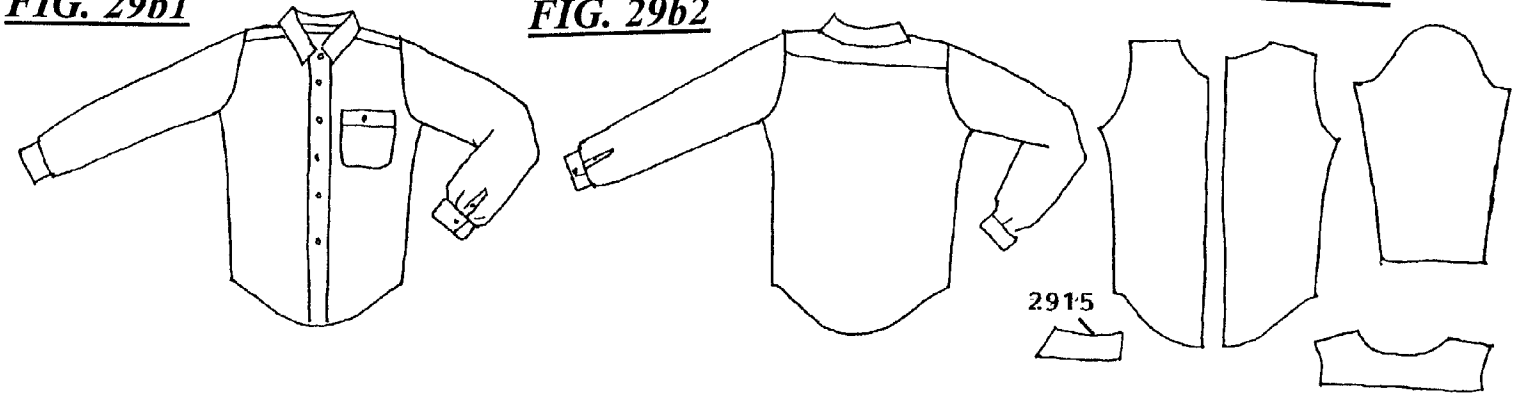
FIG. 29b1
FIG. 29b2
FIG. 29b3

FIG. 30b1
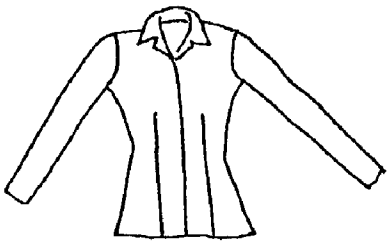
FIG. 30b2
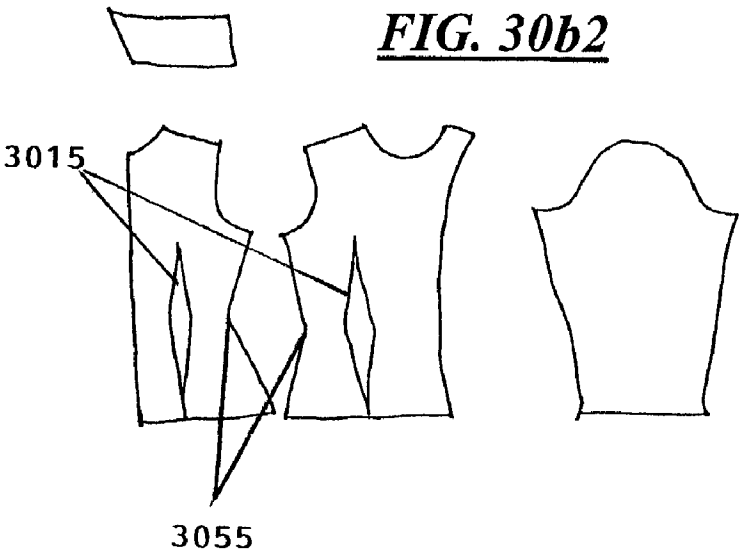
FIG. 30a1
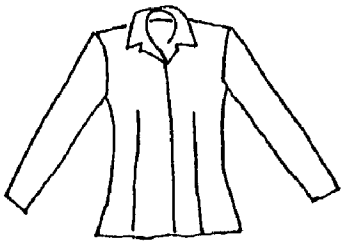
FIG. 30a2
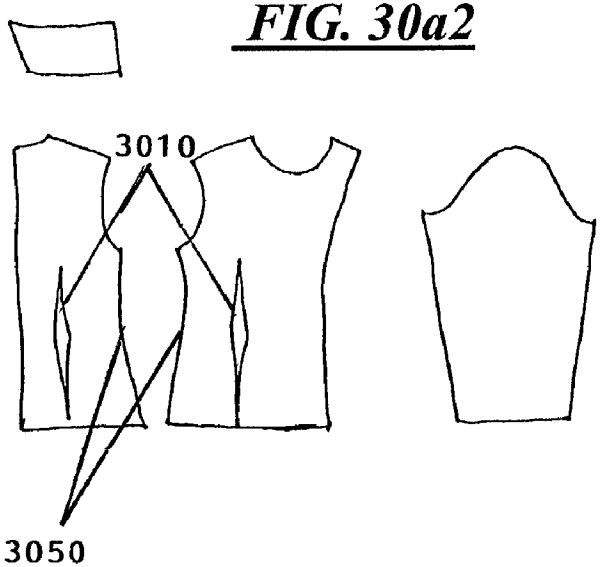

FIG. 31a1
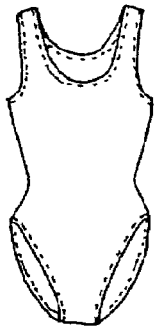
FIG. 31b1
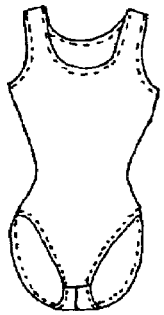
FIG. 31a2
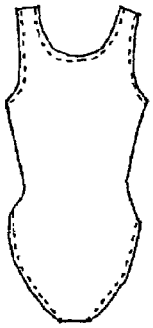
FIG. 31b2
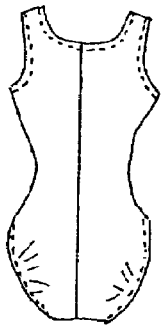
FIG. 31a3
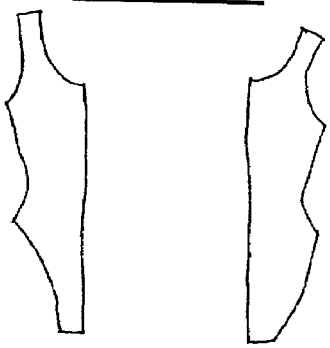
FIG. 31b3
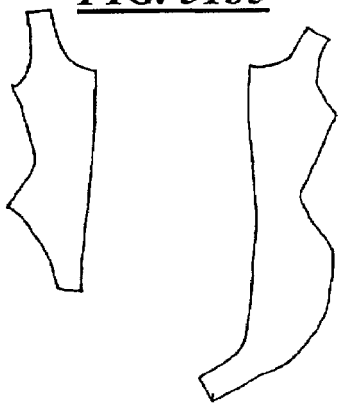

FIG. 32a1
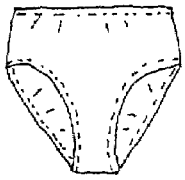
FIG. 32b1
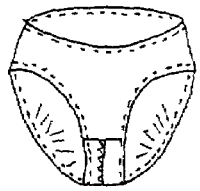
FIG. 32a2
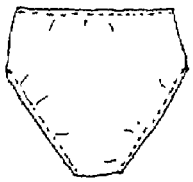
FIG. 32b2
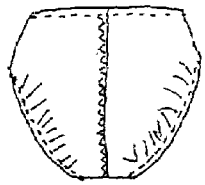
FIG. 32a3
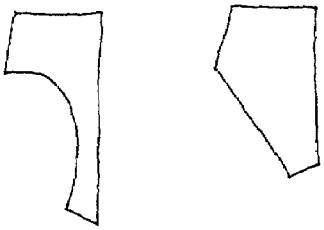
FIG. 32b3
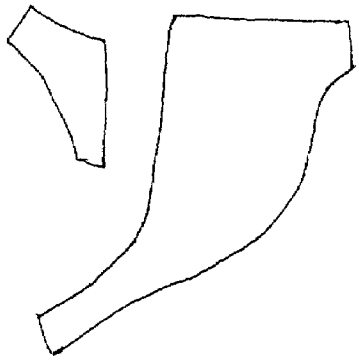

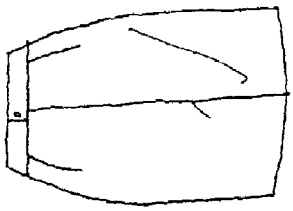
FIG. 34b2
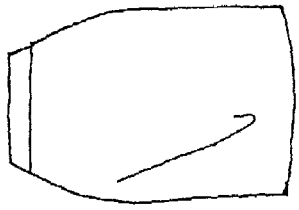
FIG. 34b1
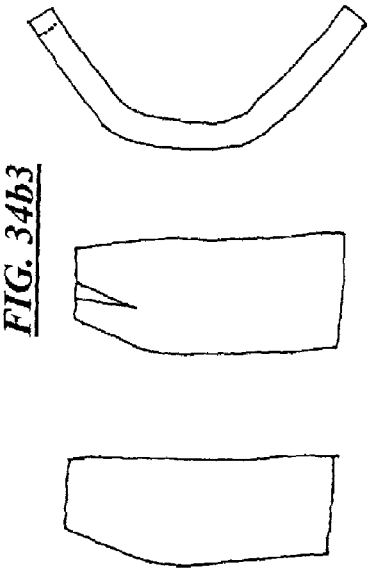
FIG. 34b3
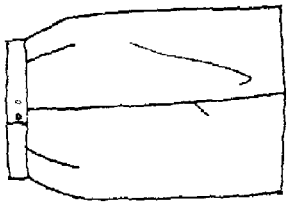
FIG. 34a2
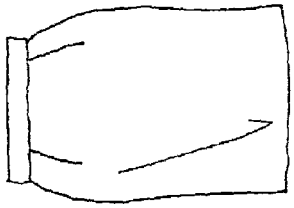
FIG. 34a1
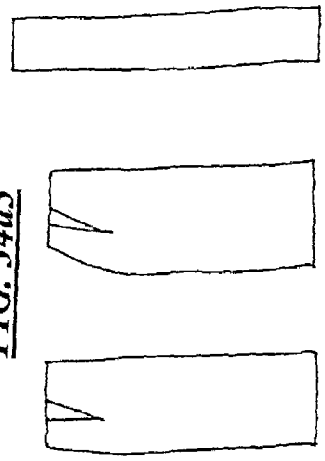
FIG. 34a3

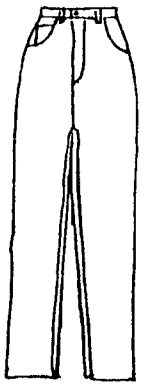
FIG. 35a1
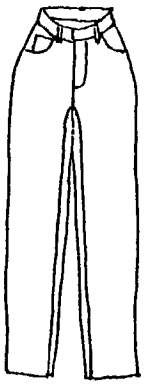
FIG. 35a2
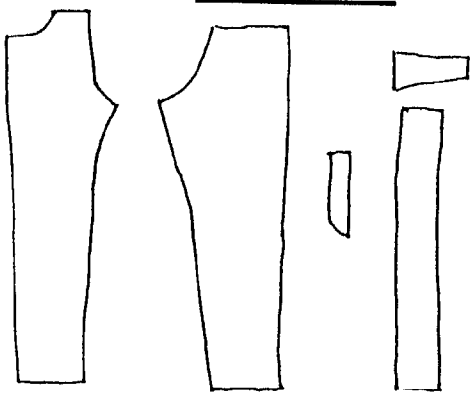
FIG. 35b1
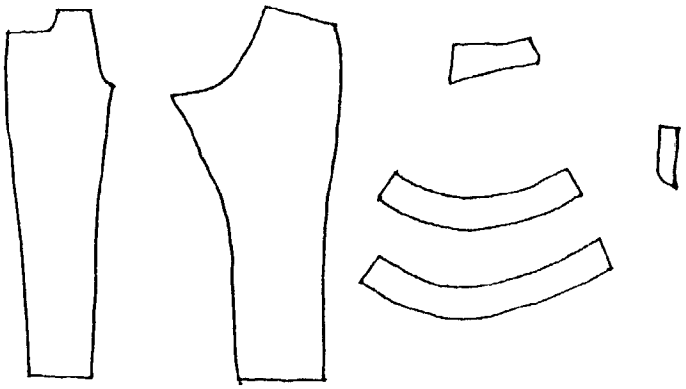
FIG. 35b2

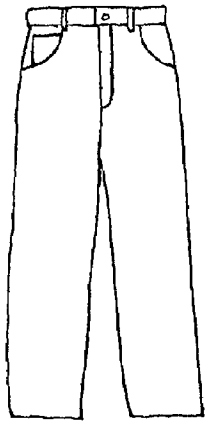
FIG. 36a1
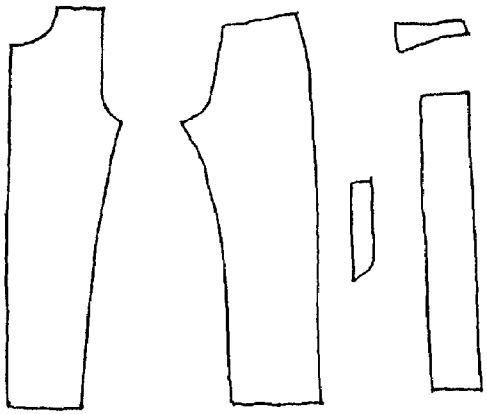
FIG. 36a2
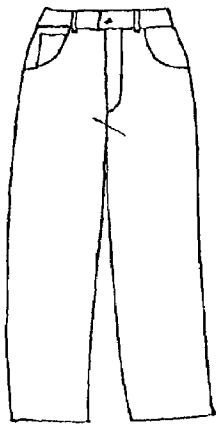
FIG. 36b1
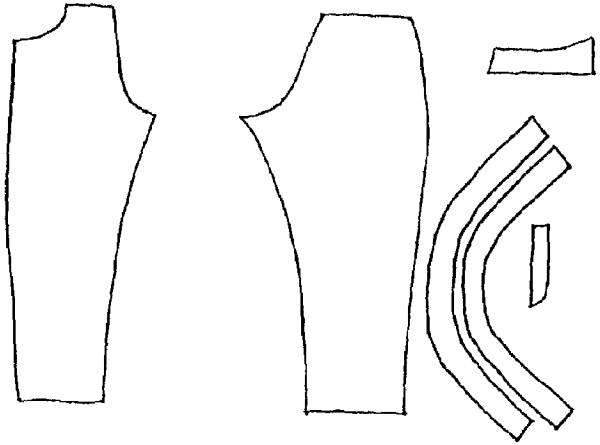
FIG. 36b2

PATTERNING SYSTEM FOR A SELECTED BODY TYPE AND METHODS OF MEASURING FOR A SELECTED BODY TYPE

BACKGROUND OF THE INVENTION AMENDMENTS

1. Technical Field of the Invention Amendments

This invention pertains to a patterning system and the creation of a standard sizing system for the human body of the Black race. This invention envisages body measurements, size designation, and a patterning system for the Black human body, and specifically, a patterning system incorporating different Black body types in the design of ready-to-wear apparel, apparel fitting forms and other articles of clothing, as well as other items worn on the human body for protection or ornamentation. This invention also envisages a method of measuring in order to form a more accurate patterning system for the Black human body type.

2. Background Amendments

Reviewing Western culture, once it was customary for each household to produce most of the things it needed. In the American colonies nearly every home possessed a spinning wheel and a handloom. The mother frequently spun cotton or wool yarn on her spinning wheel. Then she wove it into cloth on a handloom, and made the cloth into clothes for family members. Because the clothes were made for specific family members, they were fitted as desired. The invention of the spinning jenny and the power loom in the late 1700s revolutionized textile-making methods. These machines made it possible to turn out cloth in greater quantities than ever before. Gradually, textiles were no longer woven in the home, and practically all cloth became a factory product. The first American textile mills and various other factories were built in the early 1800s, and so began the mass production of non-tailored garments and other items suited to protect, support or accommodate the human body.

Virtually all clothing manufactured today results from the Voluntary Product Standard PS 42–70 sizing system also known as the industry-standard. Additionally, all commercial pattern companies in the United States use the same industry-standard body measurements, adopted by the National Bureau of Standards. The industry standard is based on a 1941 study, consisting of only young, White volunteers.

After years of curiosity, speculation, and inquiry regarding the needs of non-industry-standard human bodies, I have invented a patterning system to solve many problems for groups of individuals of the Black race who are not adequately fitted by the current single industry-standard. Generally, industries that design or manufacture items fitted for accommodating the human body are producing items that fail to fit a very substantial percentage of the human population., namely the Black race. Some think that the reason the industry-standard sizing system fails to fit many Black human bodies is because of the different "body types" that exist among the human population. It is thought that age may be the primary contributor to differences in body measurements and physique. However, "body types" and the "body" are two very different classifications. Typically, "body types" are sub-categories of the "body". Body types usually refer to body shapes, i.e. pear-shaped, hour-glass, boxy-shaped. These references to outer shape do not always represent the proper anthropometric measurements (body measurements) of the human physique or body structure. I have invented a system for measuring the Black body which includes, but not limited to, the unique bone proportion that remains consistent in this particular race of people and is not identical to any other race of people.

Contrary to the statement by Bruno Ferri in "One Size Fits All the Way to Middle Age" (New York Times, February, 1993), the source of differences in human bodies is not so much a function of aging as ethnicity which transcends age differentials. While age may have some influence on body measurements, what may appear to be a function of aging is more a function of health. A change in health is often manifested by a change in body mass. When the mass associated with an individual of a particular human body physique is changed, the mass change does not affect the human body physique; rather, the change has an affect on the appearance of the body surface. Therefore, a change in health that results in a body mass decrease may accentuate bone structure distinctions or camouflage flesh accumulation distinctions in a body. Also, where the body mass decrease involves a decrease in body muscle, the body becomes camouflaged. Where the body mass decrease involves decrease in body fat, the body becomes accentuated. As well, a change in health that result in a body mass increase may accentuate or camouflage, not alter, the human body structure. Where the body mass decrease involves an excessive increase in body fat, the body becomes camouflaged. Where the body mass increase involves an increase in body muscle, the body type becomes accentuated. Health rather than age is the greater impact on the appearance of the body. Notwithstanding, regardless of health or age, a body structure remains constant throughout the life of a human.

Development of an effective patterning system for a Black body requires a number of ethnicity solutions. A Black ethnicity solution appreciates differences in bone structure based on body physique. A Black ethnicity solution recognizes that a body part positioning can distinguish a Black body from an individual of a different race. A Black ethnicity solution takes into consideration that different human body physiques have respective propensities and distributions for muscle mass and fat mass. In addition, beyond the distinctions in bone structure, body part positioning, muscle and fat mass accumulation and the location of muscle and fat mass accumulation, which are all to some degree involved in body landmark it is critical to recognize how body type specific contours correlatively connect one body landmark to another landmark on the skeletal frame in order to adequately represent the three-dimensional shape of a Black body type. Therefore, a more precise Black body shape description depends on contour information. The distinctions noted herein above are some of the primary distinctions in Black human body physiques.

The demand for products made for the Black body including, but not limited to, ready-to-wear, apparel dress forms, other items of clothing as well as other items worn on the body for protection or ornamentation has heightened over the years, and until this invention the market remained void of an effective method and product to comprehensively solve the problem of the single industry-standard patterning system, which produces ill-fitting apparel for a significant percentage of Black consumers.) Heretofore, there has been considerable discussion on the subject of patterning, for apparel and other consumer items, by Black consumers. There is a growing desire of people with non-industry-standard bodies and certain members of the design industry, to have available mass-produced items fitted for the Black human body. Supporting articles and research state:

"It is recommended that the sizing system be up dated with new measurement data that includes African American females and also that more research involving measurement standards and sizing systems be expanded to include females of other ethnic groups." (Wadeeah Beyah and Shu Hwa 2001, African American Female Measurements and the Standard Sizing System, International Textile And Apparel Association.)

"In contrast, Black youth have absolutely and relatively longer lower extremities than Mexican Americans and White Americans." (American Journal of Physical Anthropology 72: 89–94, 1987)

It is a commonly known fact that a particular apparel garment designed to fit a White human body of a particular industry-standard size range tends not to as adequately fit a Black human body who appears to be in the same industry-standard size range as the White human body. The problem is that even though the White human body and the Black human body are of the same sex, height, weight, and age, the two human bodies represent different human body physiques. Mass-produced apparel tailored to perfectly fit a human body having an industry-standard body fails to fit masses of humans with bodies that must be classified within that particular industry-standard body size. Such fit failures indicate that what is perceived to be the standard pattern design for tailoring to the human body, is merely an industry-standard for one or very few selected human body physiques.

The conventional apparel form is a classic example of how the industry-standard does not accommodate a non-industry-standard body. With an apparel form, typically, increasing or decreasing certain flexible components of the apparel form achieves different sizes. However, by way of example, an industry-standard apparel form cannot result in a quality tailored garment for an individual with the Black body type because the industry-standard fails to capture the accurate contours and the proportions, which are essential components of the Black body type. In more specific example, increasing the hip measurement on an industry-standard apparel form may yield the desired objective measurement yet does not result in the proper contours at the hip area of an individual with the Black body type. Further, a relatively small industry-standard waistline is provided on an apparel form with limited hip expansion at the hip area, based on the small waistline. On the Black body type, a small waistline does not necessarily indicate a relatively small hip, as required by the industry-standard. Moreover, the hip of a Black body type is not positioned according to an industry-standard apparel form.

Every woman wants her clothes to look as though they were made especially for her. Women who easily fit industry-standard sizing have beautifully fitted ready-to-wear clothes available. Many Black women who find it difficult to obtain a comfortable, attractive fit in ready-to-wear clothes, are referred to as having "figure problems", "figure defects", "figure faults" or "figure flaws". Industry-standard garments are designed for White women with, among other criteria, hip measurements generally no more than two inches greater than their respective bust. According to the industry-standard, a woman who is not proportioned as such represents a "figure problem". Overwhelmingly, there is no positive acknowledgement by the apparel industry of the genetic fact that large groups of women have bone structure, body frames, muscle propensity distribution and fat propensity distribution that does not conform to industry-standard patterning. In a time when issues of diversity are at the forefront, it is insensible to ignore the fact that a single industry-standard does not fit all human body structures.

When an individual with the Black body, purchase articles of clothing having industry-standard sizing, the clothing is not being purchased according to its size because size is a relative assignment. Rather, the article is being purchased because of its width and/or its depth at particular body landmarks. Therefore, an individual with a Black body may purchase different article of clothing, i.e., shirts, pants, underclothes, hat and gloves, in different and inconsistent industry-standard sizes because traditional thought regarding industry-standard sizes is not reliable when the human body is not an industry-standard body.

Continuing with the example of the Black body in contrast to industry-standard body, one of the most destructive forces of self-esteem of young girls and women who have the Black body type takes its toll when these females enroll in consumer education, textile, modeling, or any other classes that involve apparel making or wearing. What these females abruptly learn is that they have a body that is outside of the accepted norm. In other words, they are abnormal. To no avail, many of these females have almost starved themselves to death with an ill-fated hope of finding a "normal" body beneath the shed body mass. These frustrated, bone-thin females still do not conform to the "norm" because it is not merely mass of body flesh that distinguishes the appearance of a human body. The present invention discloses that human body physique and or structure establishes distinctions in the appearance of a human body, and ethnicity solutions-bone structure, bone placement, muscle mass propensity and distribution, and fat propensity and distribution—are primary factors that determine body structure.

Females of similar age, height, and weight can have dissimilar bone structures, bone placement and mass distribution where the females are of dissimilar human body structures or physiques. For example, a recent magazine article noted comments regarding body shakes during dancing and cheers by African-American high school cheerleaders in comparison to Caucasian cheerleaders. (Sports Illustrated, Dec. 24, 2001) Some school board members referred to the dancing and cheers of African-Americans as luridly, when in reality, the difference in appearance was substantially attributable to the selection of dances and cheers that involve shaking the hips, a body part on the Black body where bones tend to protrude and a mass is concentrated, which is not the case for the industry-standard body.

One very common problem not adequately addressed by the one industry-standard patterning system is differences in height. For example, according to traditional thought, variances in height among women of the same hip measurement is accommodated by producing a petite dress that in general is merely an industry-standard dress with shorter sleeves, shorter dress length and perhaps a shortened bodice. Industry-standard sizes do not take into consideration that the petite Black woman nevertheless has a Black body. Therefore, even industry-standard petite dresses are problematic for the petite Black woman. Industry-standard petite dresses tend to have sleeves that do not extend to the wrist of the petite Black body and dresses of inadequate length for the Black body. In brief, the industry-standard does not take into consideration that each human race or group body structured has its own, unique height range. Moreover, while industry-standard petite bodices are patterned shorter than the "normal" industry-standard bodice, when fitting the petite Black body the multiple reasons for a short bodice are not overcome by an industry-standard petite bodice that was too lengthy to begin with, and whether or not petite, does not take into consideration the chest width difference in the industry-standard and the Black body.

The industry-standard mislabels body locations in a derogatory manner. For example, the Black body defines a particular waistline location as normal, whereas, the industry-standard refers to an individual with the Black body waistline location as "high-waisted" or "off-standard". Actually, the waistline on the Black body is not low, relatively speaking. The confusion lies in the fact that, unlike with the industry-standard body, the position of the navel and the position of the waistline do not coincide. The waistline in front of the body on the Black body is generally located 1.0 to 2.0 inches below the navel, and the waistline on the industry-standard is generally located at the navel. On the Black body, however, the chest is short in comparison to the industry-standard body. Therefore, on a short-chested body, a "normally positioned" waistline may have the appearance to some of being "high-waisted" or "off-standard".

Retail salespersons have often directed individuals of the Black body to purchase improperly sized items because the merchant is able to provide only industry-standard sized items that fit out of proportion to the body parts of the Black human body. For example, when a glove does not completely fit over a Black human body hand, retail salespersons have directed the consumer with the Black human body hand to purchase a larger size glove than indicated by the consumer's palm size. The primary variable not considered, is the longer than industry-standard digits on the Black human body hand for that particular sized palm. In other words, the patterning system of the present invention caters to proportions and contours not recognized in the industry-standard, although the body sizing may be standard for consumers with a White body.

Industrial accidents occur on jobs where the hands of industrial workers are inadequately protected. Many industrial workers have a human body structure other than the industry-standard body, and that includes hands. The safety of the workers and liability of the employers depend on adequately protecting the workers. In the United States, most work related gloves are produced in one plant in Glovesville, N.Y., and are made according to industry-standard sizing. By contrasting example, Black body hands tend to have digits that extend longer than industry-standard size digits, when comparing equivalent sized palms. Gloves that are ill-fitted because they are too tight, too short in the digit length, restrict the maximum us and rotation of fingers, hand, and wrist of workers. This constitutes higher constitute liability for employers.

Of recent, the United States has witnessed the proliferation of mostly young men wearing extremely loose fitted, extremely long pants. This trend began in the urban areas of the United States where there are concentrations of men with a Black human body. A part of the impetus for this trend is the industry-standard apparel system. Most male pants are cut from the industry-standard pattern design wherein the waist-hip measurement ratio is approximate 1.0×: 1.10×, respectively. On the other hand, with the Black body, the waist-hip measurement ratio is approximate 1.0×: 1.20×, respectively. Given the difference in the measurement ratios, coupled with the difference in the positioning of body parts, industry-standard pants that fit the Black body waist are uncomfortable in the hips, thighs and crotch. Therefore, industry-standard pants that comfortably fit the hips, thighs, and crotch of a Black body tend to be oversized for the Black body waist.

Further regarding body parts positioning, the Black body waist is not similarly positioned as the industry-standard body. In order to position the waistband of the industry-standard pants on the Black body waist, the industry-standard must ride low in the seat. This low riding seat does not serve the Black body type because the Black body bone structure and flesh distribution does not correlate with the low riding seat resulting from the location of the industry-standard waistband. In the absence of a belt or other retention means, the integrity of the location and fit of the industry-standard pants waistband when worn on the Black body waist is compromised; thus, industry-standard pants hang from the Black body, causing the long crotch of the industry-standard pant to droop in greater excess than normal and the pants legs to be out of expected position, appearing to have excessive leg length and width.

The applicant determines a need for a patterning system that is adaptable for a Black human body. It is essential that the patterning system is capable of taking into consideration one or more ethnicity solutions. One or more Black ethnicity solutions are important in order to adequately represent a Black body in a patterning system utilized by the designers and the apparel industries. There is a growing demand for mass-produced, comfortable and attractively fitting apparel for a Black body. The patterning system of the present invention meets the stated market demand.

In brief, the noted above and other difficulties with industry-standard patterning systems have resulted in economic injury to employees and merchants, discomfort and personal-image damage to individuals with a non-industry-standard body, and deterioration of social values.

The industry-standard suffers from several problems. The fallacious notions of the appropriateness of virtually a single White industry-standard for items patterned for mass production, coupled with the substantial number of individuals with non-industry-standard body, clearly indicate it is meritorious to conclude that the market place will support more than a single patterning system and standard sizing guide. The patterning system of the present invention improves upon the relevant art by solving a problem not adequately addressed previously, that problem being patterning for a human body structure other than the industry-standard. The present invention provides a system and method of designing patterns for use by a Black human body.

3. Art

Numerous devices exist on the market to aid designers and manufacturers in creating and manufacturing well-fitted apparel items. Such devices are limited in their services. The present invention overcomes limitations in the art that do not serve the Black human body.

U.S. Pat. No. 3,939,565, a pattern fitting tool and method of custom fitting patterns, issued Feb. 24, 1976, to Roberta F. Bush, describes a fitting tool and method of custom fitting patterns utilizing a plastic pattern form. Unlike the present invention, '565 does not describe a method of mass-production for the apparel industry such that the benefactors include designing houses, manufacturers, wholesalers and retail merchants.

U.S. Pat. No. 4,894,919, a garment pattern adaptation system, issued Jan. 23, 1990, to Beate I. E. Ziegertit describes a means for modifying a garment pattern for use with knitted elastometric stretch fabrics by removing body ease and reducing length and width. Unlike the present invention, '919 does not involve the challenge of creating a patterning system for a Black body types. At '919, the intent is to describe a means of working with stretch fabrics that maintains the proportions of the industry-standard pattern.

U.S. Pat. No. 5,615,318, a method and apparatus for visualizing assembled sewing patterns, issued Mar. 25, 1997, to Susumu, Matsuura appears to disclose a computerized method and apparatus for visualizing assembled sewing patterns which allow a user to observe the appearance and wearing condition of clothes by converting a two-dimensional pattern into a three-dimensional pattern. The three-dimensional coordinate values that indicate the shape formed by assembling the sewing pattern pieces are calculated and the three-dimensional coordinate values and the main dimensions are inputted. Unlike the present invention, the disclosure of '318 is limited to converting existing two-dimensional data into three-dimensional data and discloses neither novel techniques for creating three-dimensional data nor novel techniques for creating two-dimensional data for a Black human body since a sizing standard did not exist at the time of invention.

Numerous dress forms are known. U.S. Pat. No. 3,734,362, dressmaking forms, issued May 22, 1973, to Eric Richard Arthur describes a patterning system consisting of a plurality of sections that are adjustable. The overall circumferential size of the sections can be increased or decreased by setting dials for each part of the form. U.S. Pat. No. D444,818 S, a dress form, issued Jul. 10, 2001, to Kenneth Henry Fullalove, is a adjustable dress form. In both '362 and '818, the adjustments are restricted to industry-standard body proportions. Neither '362 nor '818 accommodate Black ethnicity solutions.

U.S. Pat. No. 5,014,364, a garment crotch structure and method, issued May 14, 1991, to Donna R. Orr discloses a garment with the feature of providing an opening which may be used to perform bodily functions without removing the garment. Unlike the present invention, while the garment is adjustable, it is not disclosed to be adjustable to the Black body.

U.S. Pat. No. 3,907,107, a dress form method and means, issued Sep. 23, 1975, to Flora M. Vercollone; U.S. Pat. No. 3,525,458, a dress form, issued Aug. 25, 1970, to Robert S. Mason et. al; and U.S. Pat. No. 5,566,867, a customizable garment form system, issued Oct. 22, 1996, to Jill Goray, consistently disclose patterning form kits which can be assembled and customized. Such disclosures are limited in function to service individual users. The market desires a product that serves groups of individuals of similar body structure beyond the industry-standard body.

U.S. patent application Ser. No. 09/685,311, a body profile coding method and apparatus used for assisting user to select wearing apparel more appropriate to users body, issued Jan. 10, 2002 to Peter Ar-Fu Lam discloses a device that assists user with choosing more accurate sizes based on user's height and some algorithms. '311 assumes the user has a human body structure or physique same or similar to the industry standard. '311 is limited to obtaining all key ethnicity solutions because it only captures profile data.

The art identified hereinabove does not permit for mass-produced, well-fitted apparel and other items for individuals with a Black body because virtually no product of the art takes into account Black ethnicity solutions at a level that results in mass-produced items tailored to a non-industry-standard body.

In brief, all known efforts are limited because:

(a) Industry-standard patterning systems do not accommodate the critical differences in the industry-standard body the Black body types.

(b) Patterning systems that provide for customized tailoring for individuals with a non-industry-standard body do not serve the needs of the apparel industry.

(c) Currently available adjustable forms and molds that allow for enlargements in body parts do not adequately accommodate the Black body.

(d) Industry-standard sizing systems may be a significant source of lost revenue because industry-standard sized items do not adequately cater to human body structures other than the industry-standard.

(e) Industry-standard sizing systems have contributed to the proliferation of young men wearing extremely loose fitting, excessively long pants, because of an awareness of the necessity of comfort.

(f) Industry-standard sizing systems have contributed to the low self-esteem of many young girls and women who have become frustrated in their efforts to achieve an industry-standard body type.

(g) Industry-standard apparel items represent a source of worker's compensation claims and lost employer profits.

The noted above and other difficulties with industry-standard patterning systems have resulted in economic injury to employers and merchants, discomfort and personal-image damage to individuals with a non-industry-standard body, and deterioration of social values.

The industry-standard suffers from several problems. The fallacious notions of the appropriateness of virtually a single industry-standard, based on only White volunteer subjects, for items patterned for mass production, coupled with the substantial number of Black individuals with a non-industry-standard body, clearly indicate it is meritorious to conclude that the marketplace is beyond ready support more than a single patterning system. The patterning system of the present invention improves upon the relevant art by solving a problem not adequately addressed previously, that problem being patterning for a Black human body structure other than the industry-standard. The present invention provides a system and method of designing patterns for use by the Black body. None of the known art approaches the apparatus content and function of the present invention.

AMENDED SUMMARY OF THE INVENTION

According to the present invention, there is provided a patterning system to accommodate a Black human body physique. The patterning system of the present invention advantageously considers the height and weight of an individual representing a Black human body, at least one body landmark measurement and at least one ethnicity solution of the Black body. The present invention further involves combining the multiple variables considered in order to show relationship and correlative assembly of the variables on a patterning surface, which provides a means of recording the patterning system.

The disclosed patterning system provides an optimal method of tailoring apparel to a Black body, while eliminating the previous requirement of individualized tailoring. The method of patterning according to the present invention can be carried out with substantially increased accuracy in apparel fit for a Black body that is not the industry-standard body. A merchant that markets apparel directed to a Black human body physique is likely to experience fewer sales returns associated with the "right size" apparel that "did not fit" when merchandise is produced from the patterning system of the present invention. Industry accidents may reduce.

In at least one embodiment of the invention, the patterning system is directed at apparel items. Moreover, as appears in greater detail hereinafter, the invention allows for patterning to accommodate a wide variety of items that come in contact with the exterior surface of the Black human body.

To meet the above-noted desires, the revelation of the present invention is brought forth. It is an object of the present invention to provide a patterning system for a Black human body.

It is an object of the present invention to provide apparel that enhances health and safety.

It is an object of the present invention to disclose adjustments in the industry-standard apparel patterning system based on a Black human body An object of the present invention is to provide Black ethnicity solutions such that a patterning system accommodates a Black human body.

Moreover, the patterning system of the present invention has the object of providing a patterning system for mass-produced Black body standard apparel.

The above-noted objects and other advantages of the present invention will become more apparent to those skilled in the art as the invention is further explained in the accompanying, drawings and detailed description.

AMENDED BRIEF DESCRIPTION OF THE DRAWINGS

FIG. 1*a* is a side elevation view of an industry-standard body.

Figure 1B:
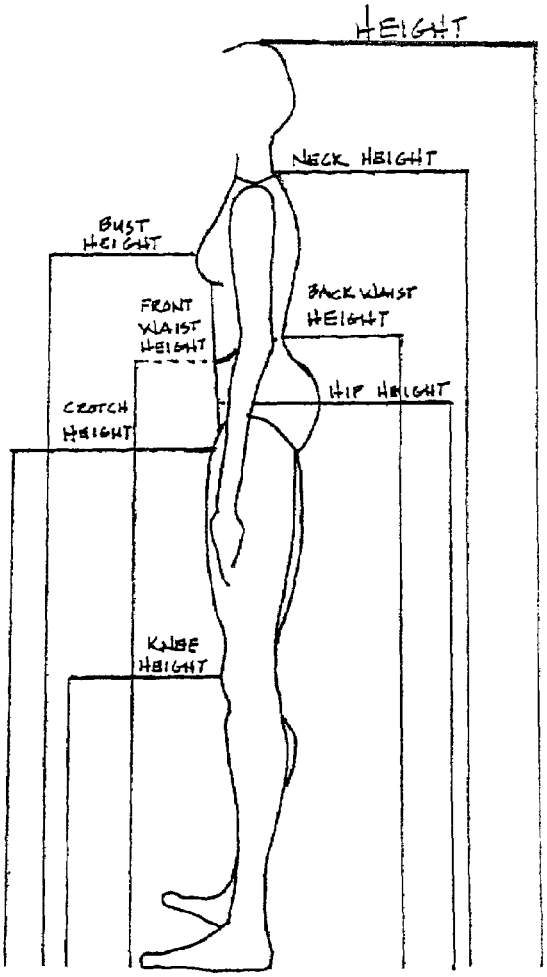

FIG. 1*b* is a side elevation of a Black body.

Figure 2A:
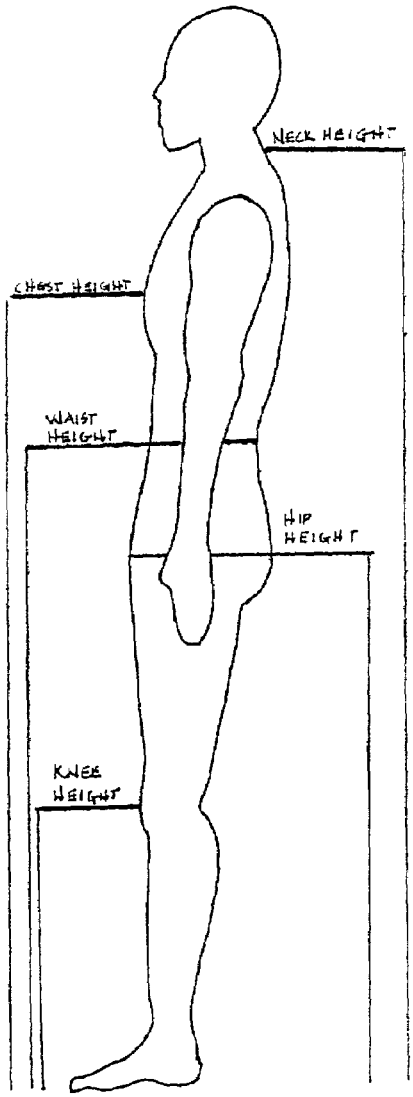

FIG. 2*a* is a side elevation view of an industry-standard body.

Figure 2B:
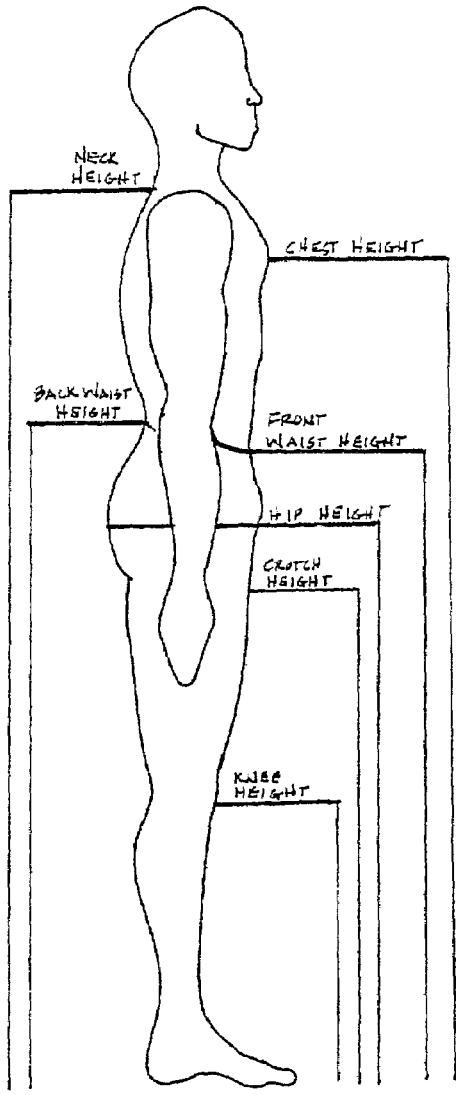

FIG. 2*b* is a side elevation view of a Black body.

FIG. 3 compares particular ethnicity solutions for the Black body and the industry-standard body.

FIG. 4 compares particular ethnicity solutions for the Black body and the industry-standard body.

FIG. 5 compares particular ethnicity solutions for the Black body and the industry-standard body.

FIG. 6 compares particular ethnicity solutions for the Black body and the industry-standard body.

FIG. 7 compares particular ethnicity solutions for the Black body and the industry-standard body.

Figure 8A:
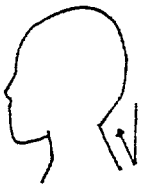

FIG. 8*a* is a side elevation view of the neck angle of the Black body.

Figure 8B:
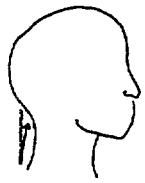

FIG. 8*b* is a side elevation view of the neck angle of the industry-standard body.

Figure 9A:
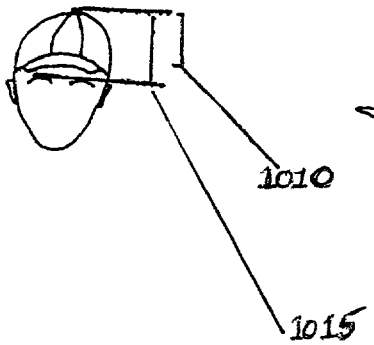

FIG. 9*a* illustrates an industry-standard cap worn by an industry-standard body.

Figure 9B:
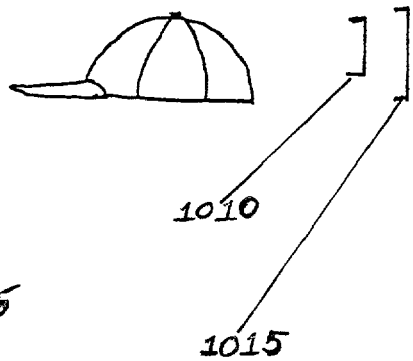

FIG. 9*b* illustrates the dimension of "hat depth".

Figures 10A, 10B:
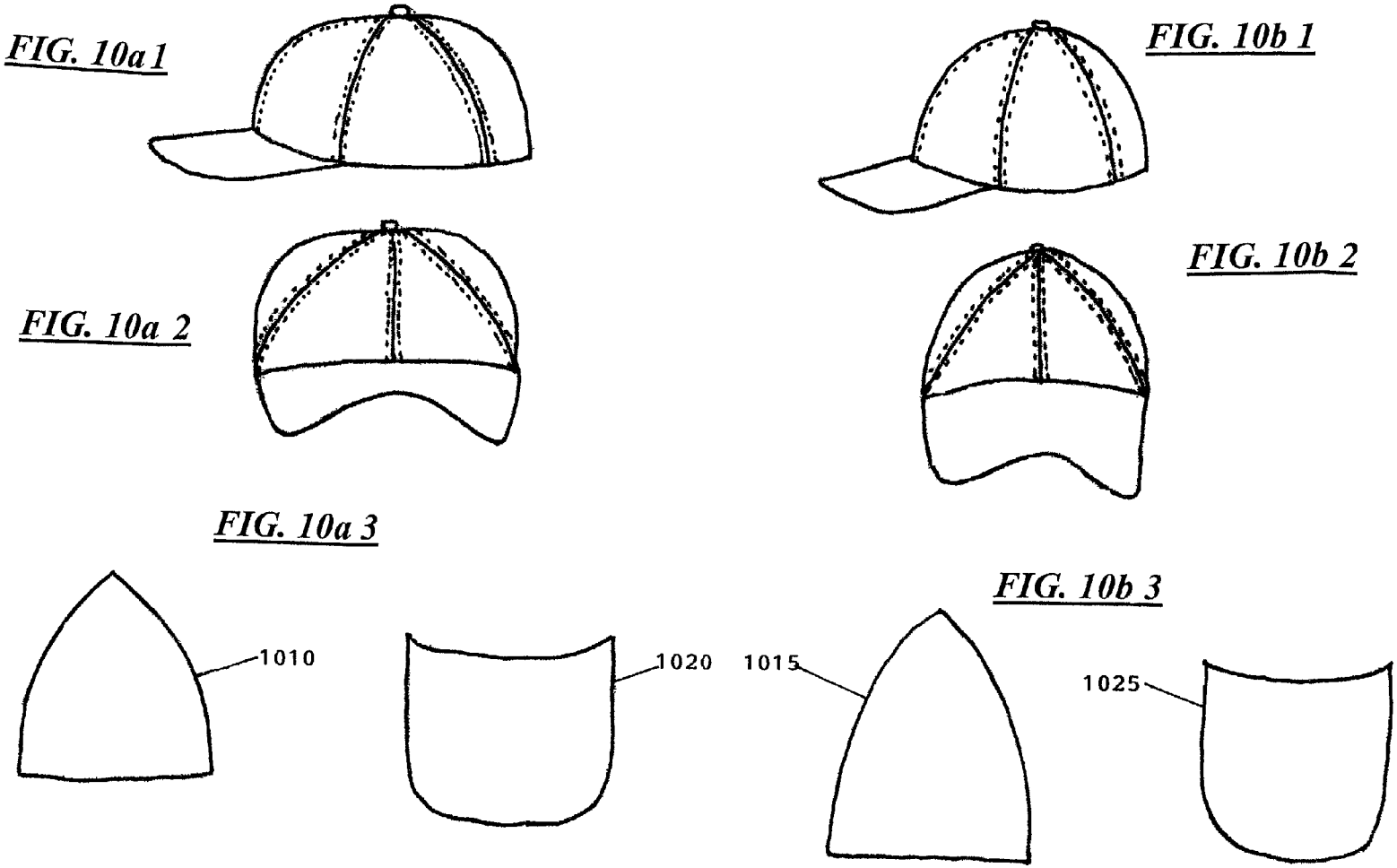

FIG. 10*a*1 is a side elevation view of an industry-standard baseball cap.

FIG. 10*a*2 is a front elevation view of the industry-standard baseball cap of FIG. 10*a*1.

FIG. 10*a*3 represents the pattern pieces of the industry-standard baseball cap of FIGS. 10*a*1–10*a*2.

FIG. 10*b*1 is a side elevation view of a Black body baseball cap.

FIG. 10*b*2 is a front elevation view of the Black body baseball cap of FIG. 10*b*1.

FIG. 10*b*3 represents the pattern pieces of the Black body baseball cap of FIGS. 10*b*1–10*b*2.

FIG. 11*a*1 is a side elevation view of an industry-standard body nose.

FIG. 11*a*2 is a front perspective view of an industry-standard body type nose of FIG. 11*a*1.

FIG. 11*b*1 is a side elevation view of a Black body nose.

FIG. 11*b*2 is a front perspective view of a Black body nose of FIG. 11*b*1.

FIG. 12*a* is a front elevation view of industry-standard lips.

FIG. 12*b* is a front elevation view of a Black body lips.

Figure 13A:
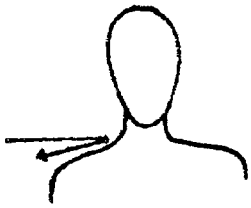

FIG. 13*a* is a front perspective view of an industry-standard body shoulder slope.

Figure 13B:
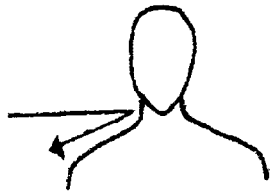

FIG. 13*b* is a front perspective view of a Black body shoulder slope.

Figure 14A:
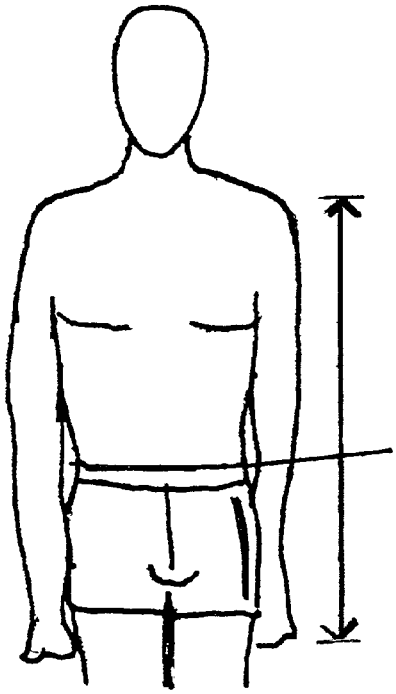

FIG. 14*a* is a front elevation view of an industry-standard body wherein waist position and arm length are indicated.

Figure 14B:
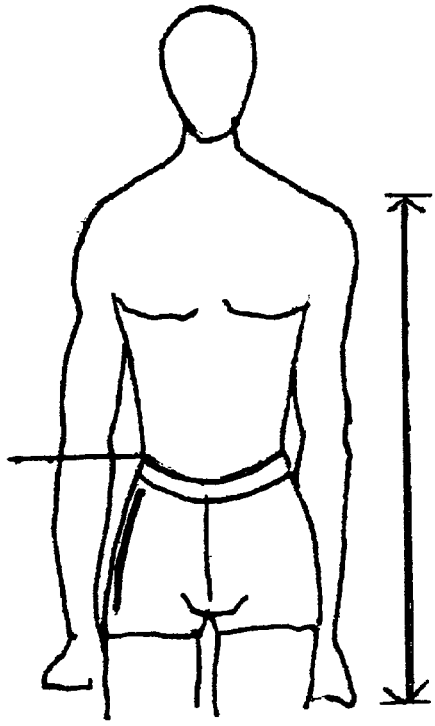

FIG. 14*b* is a front elevation view of a Black body wherein waist position and arm length are indicated.

Figure 15B:
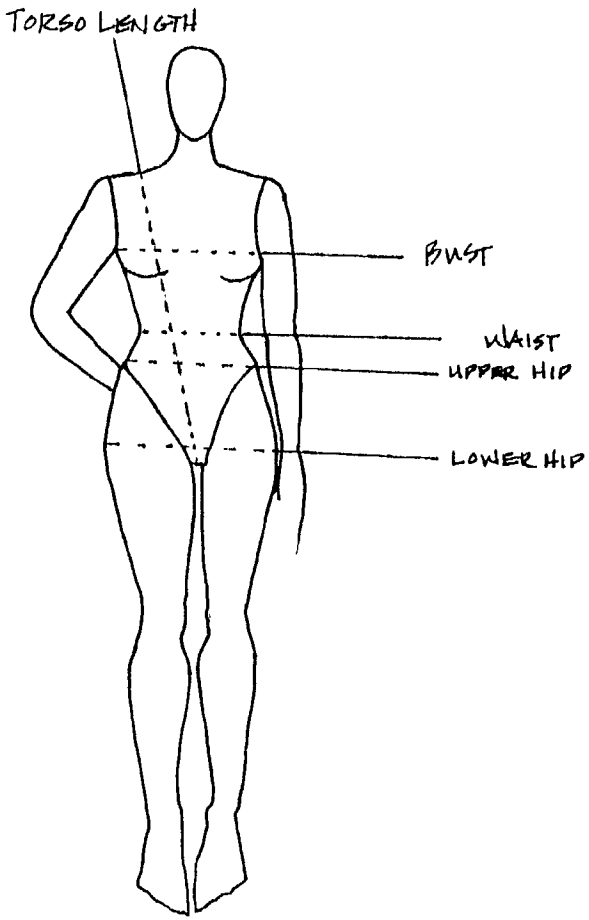
Figure 15A:
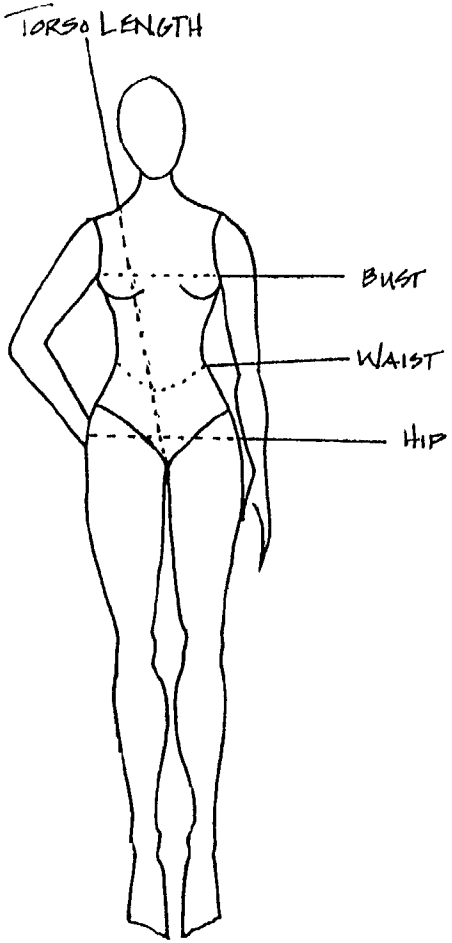

FIG. 15*a* demonstrates position of bust, waist, hip and measurement direction of torso length of the Black body.

FIG. 15*b* demonstrates position of bust, waist, upper hip, lower hip and measurement direction of torso length of the industry-standard.

FIG. 16*a*1 is a front elevation view of an industry-standard full panty on a Black body.

FIG. 16*a*2 is a front elevation view of the industry-standard full panty of FIG. 16*a*1 on a Black body.

FIG. 16*b*1 is a front elevation view of an industry-standard thong panty on an industry-standard body.

FIG. 16*b*2 is a front elevation view of the industry-standard thong panty of FIG. 16*b*1 on a Black body.

FIG. 17*a*1 is a side elevation view of an industry-standard pattern on an industry-standard body.

FIG. 17*a*2 is a side elevation view of the industry-standard full panty FIG. 17*a*1 on a Black body.

FIG. 17*b*1 is a back elevation view of an industry-standard full panty on a black pattern on a black body type.

FIG. 17*b*2 is a back elevation view of a an industry-standard Black body type full panty on a Black body with exposed gluteus.

FIG. 18*a* is a back perspective view of a Black body full panty on a Black body.

FIG. 18*b* is a side perspective view of a Black body full panty pattern type of FIG. 18*a* on a Black body.

Figure 19A:
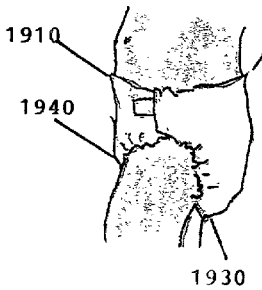

FIG. 19*a* is a side perspective view of an industry-standard diaper on an industry-standard body.

Figure 19B:
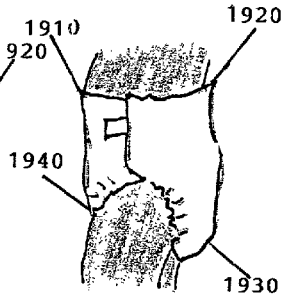

FIG. 19*b* is a side perspective view of an industry-standard diaper on a Black body.

Figure 20:
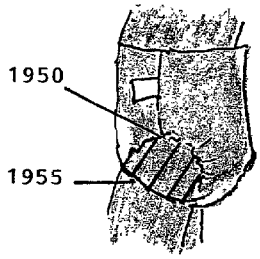

FIG. 20 demonstrates the leg cutout of an industry-standard diaper and what is desired for a Black body diaper.

Figure 21A:
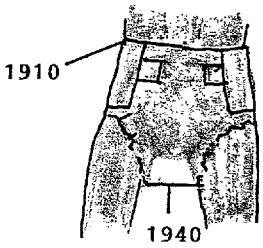

FIG. 21*a* is a front elevation view demonstrating the high front waist and the drooping crotch of an industry-standard diaper when worn on a Black body.

Figure 21B:
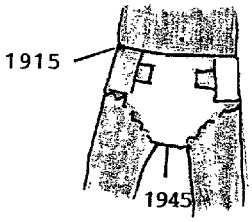

FIG. 21*b* is a front elevation view demonstrating a lowered front waist and shortened crotch of a Black body diaper.

Figure 22:
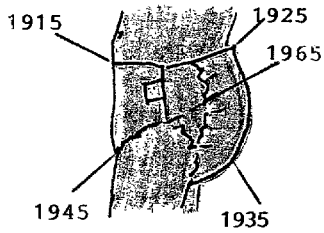

FIG. 22 is a side perspective view of a Black diaper.

Figure 23A:
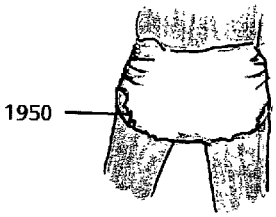

FIG. 23*a* is a back elevation view of a Black body in an industry-standard diaper.

Figure 23B:
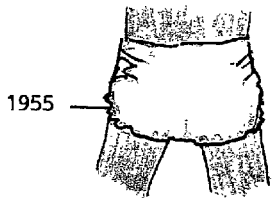

FIG. 23*b* is a back elevation view of a Black body in a Black body diaper.

Figure 24A:
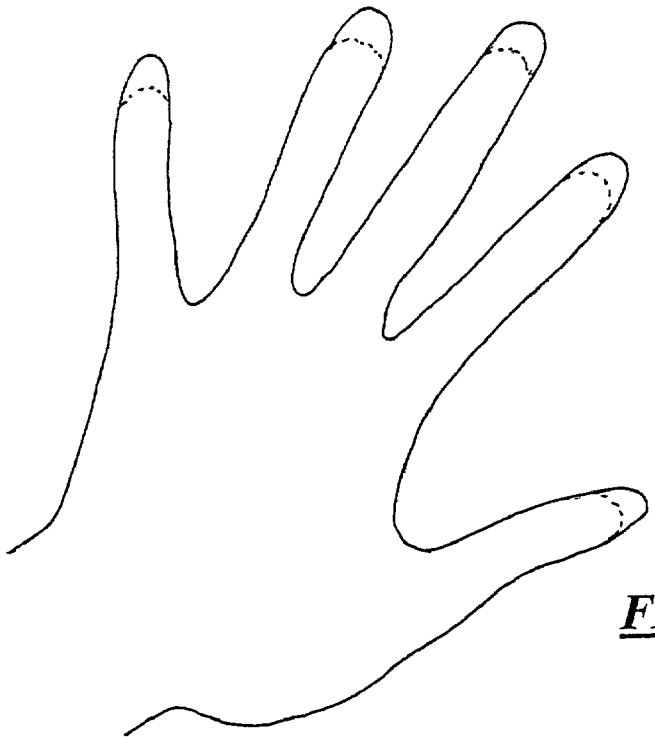

FIG. 24*a* demonstrates the additional length of the digits on the Black body in comparison to digits on the industry-standard body.

Figure 24B:
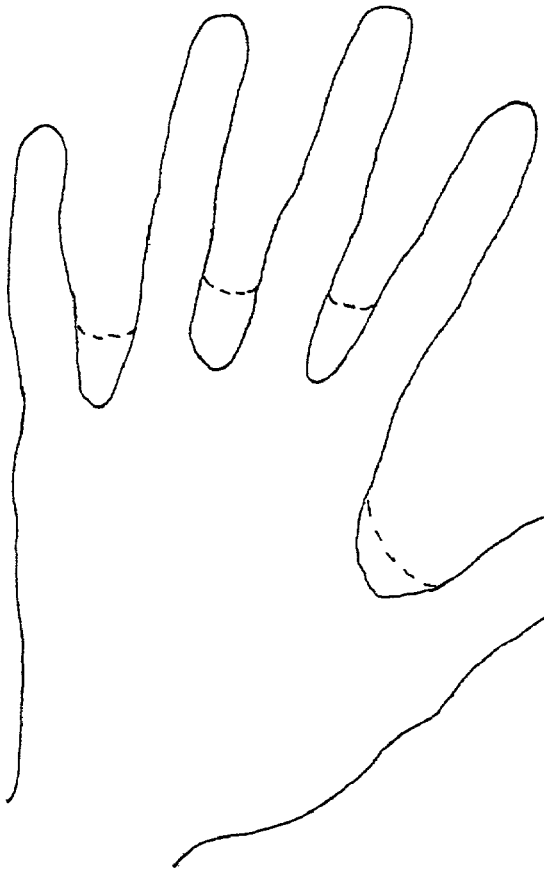

FIG. 24*b* demonstrates the area of a Black body hand not fitted by an industry-standard glove.

Figure 25:
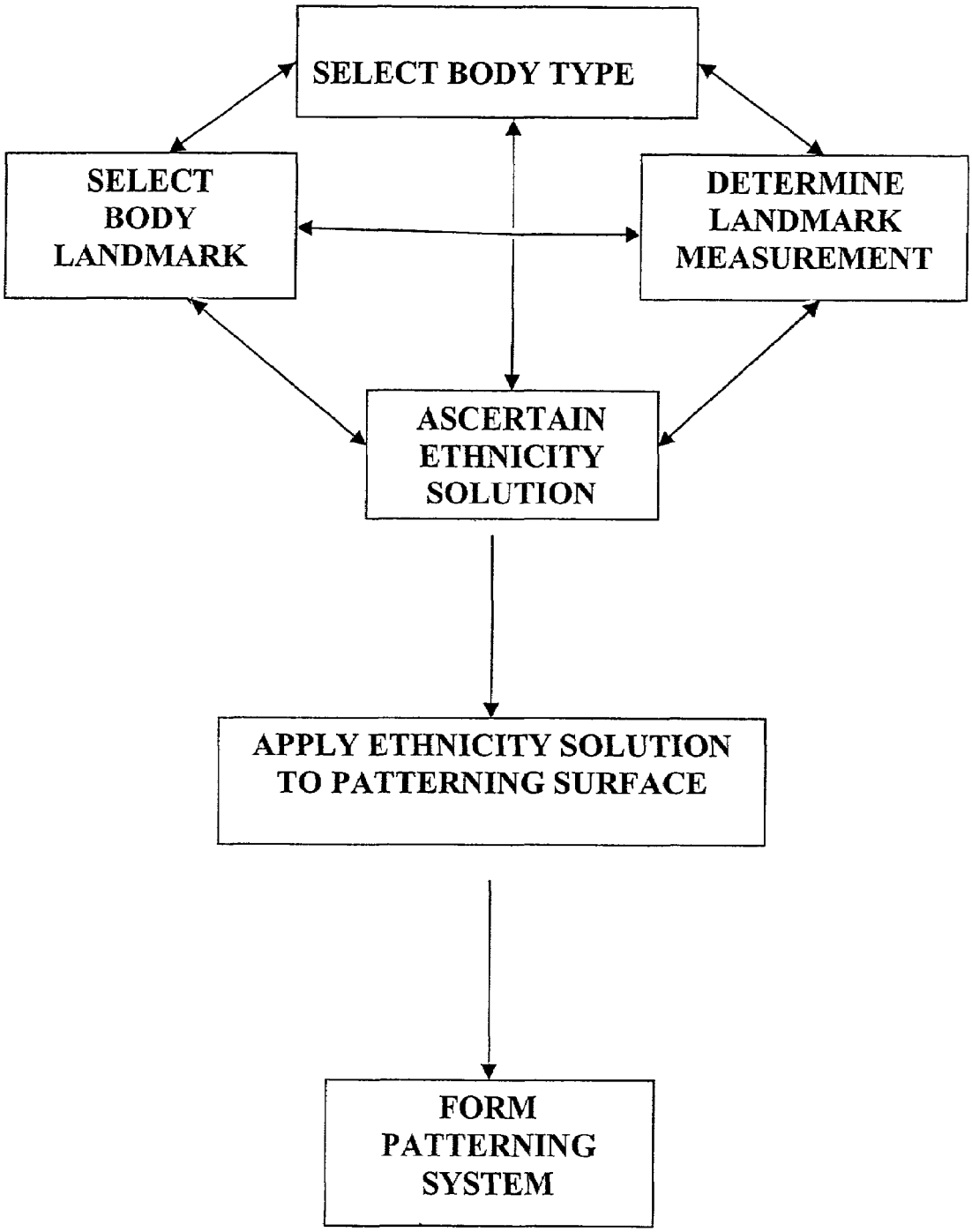

FIG. 25 is a flowchart describing a method of utilizing the patterning system of the present invention.

Figure 26B:
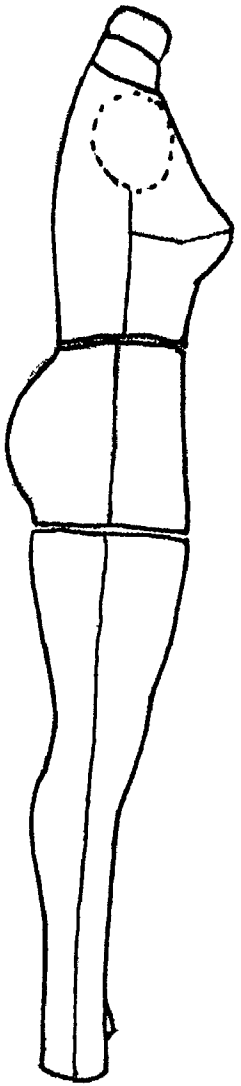
Figure 26A:
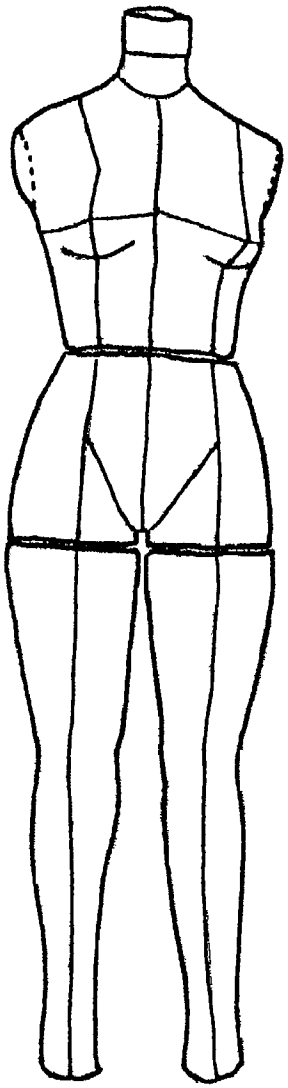

FIG. 26*a* is a front perspective view of a Black body pattern dress form.

FIG. 26*b* is a side perspective view of a Black body pattern dress form.

FIG. 27*a*1 is a front elevation view of an industry-standard brassiere.

FIG. 27*a*2 is a plan view of the pattern pieces of the industry-standard brassiere of FIG. 27*a*1.

FIG. 27*b*1 is a front elevation view of a Black body brassiere.

FIG. 27*b*2 is a plan view of the pattern pieces of the Black body brassiere of FIG. 27*b*1.

FIG. 28*a*1 is a front elevation view of an industry-standard T-shirt.

FIG. 28*a*2 is a back elevation view of an industry-standard T-shirt of FIG. 28*a*1.

FIG. 28*a*3 is a plan view of the pattern pieces of the industry-standard T-shirt of FIGS. 28*a*1–28*a*2.

FIG. 28*b*1 is a front elevation view of a Black body T-shirt.

FIG. 28*b*2 is a back elevation view of the Black body T-shirt of FIG. 28*b*1.

FIG. 28*b*3 is a plan view of the pattern pieces of the Black body T-shirt of FIG. 28*b*1–28*b*2.

FIG. 29*a*1 is a front elevation view of an industry-standard shirt for a man.

FIG. 29*a*2 is a back elevation view of an industry-standard shirt of FIG. 29*a*1.

FIG. 29*a*3 is a plan view of the pattern pieces of an industry-standard shirt of FIG. 29*a*1–29*a*2.

FIG. 29*b*1 is a front elevation view of a Black body shirt for a man.

FIG. 29*b*2 is a back elevation view of a Black body type shirt of FIG. 29*b*1.

FIG. 29*b*3 is a plan view of the pattern pieces of a Black body shirt of FIG. 29*b*1–29*b*2.

FIG. 30*a*1 is a front elevation view of an industry-standard princess dart blouse.

FIG. 30*a*2 is a plan view of the pattern pieces of the industry-standard blouse of FIG. 30*a*1.

FIG. 30*b*1 is a front elevation view of a Black body princess dart blouse.

FIG. 30*b*2 is a plan view of the pattern pieces of the Black body blouse of FIG. 30*b*1.

FIG. 31*a*1 is a front elevation view of an industry-standard swimwear.

FIG. 31*a*2 is a back elevation view of an industry-standard swimwear of FIG. 31*a*1.

FIG. 31*a*3 is a plan view of the pattern pieces of the industry-standard swimwear of FIGS. 31*a*1–31*a*2.

FIG. 31*b*1 is a front elevation view of a Black body swimwear.

FIG. 31*b*2 is a back elevation view of the Black body swimwear of FIG. 31*b*1.

FIG. 31*b*3 is a plan view of the pattern pieces of the Black body swimwear of FIGS. 31*b*1–31*b*2.

FIG. 32*a*1 is a front elevation view of an industry-standard full panty.

FIG. 32*a*2 is a back elevation view of an industry-standard full panty of FIG. 32*a*1.

FIG. 32*a*3 is a plan view of the pattern pieces of the industry-standard full panty of FIGS. 32*a*1–32*a*2.

FIG. 32*b*1 is a front elevation view of a Black body panty.

FIG. 32*b*2 is a back elevation view of the Black body full panty of FIG. 32*b*1.

FIG. 32*b*3 is a plan view of the pattern pieces of the Black body full panty of FIGS. 32*b*1–32*b*2.

Figure 33A:
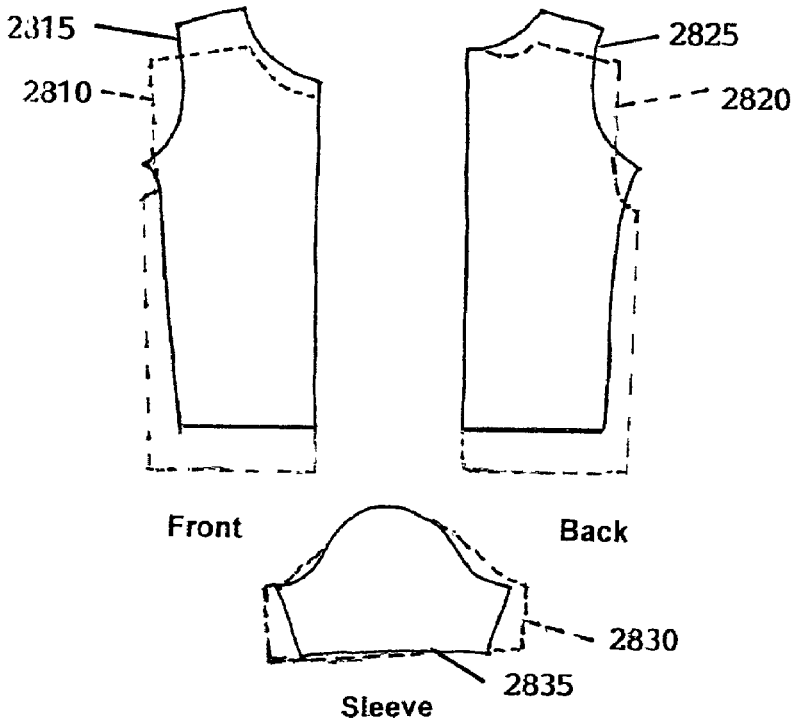

FIG. 33*a* is a plan view composite of a T-shirt pattern, contrasting industry-standard pattern pieces and Black body pattern pieces of FIGS. 28*a*3 and 28*b*3.

Figure 33B:
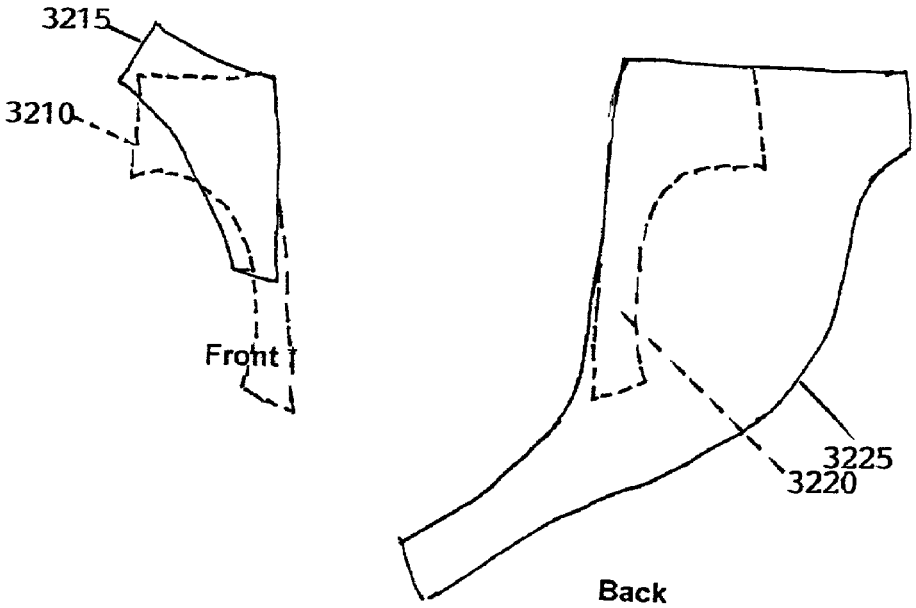

FIG. 33*b* is a plan view composite of a full panty pattern, contrasting industry-standard pattern pieces and Black body pattern pieces of FIGS. 32*a*3 and 32*b*3.

FIG. 34*a*1 is a front elevation view of an industry-standard skirt.

FIG. 34*a*2 is a back elevation view of an industry-standard skirt of FIG. 34*a*1.

FIG. 34*a*3 is a plan view of the pattern pieces of the industry-standard skirt of FIGS. 34*a*1–34*a*2.

FIG. 34*b*1 is a front elevation view of a Black body skirt.

FIG. 34*b*2 is a back elevation view of the Black body skirt of FIG. 34*b*1.

FIG. 34*b*3 is a plan view of the pattern pieces of the Black body skirt of FIGS. 34*b*1–34*b*2.

Figure 34C:
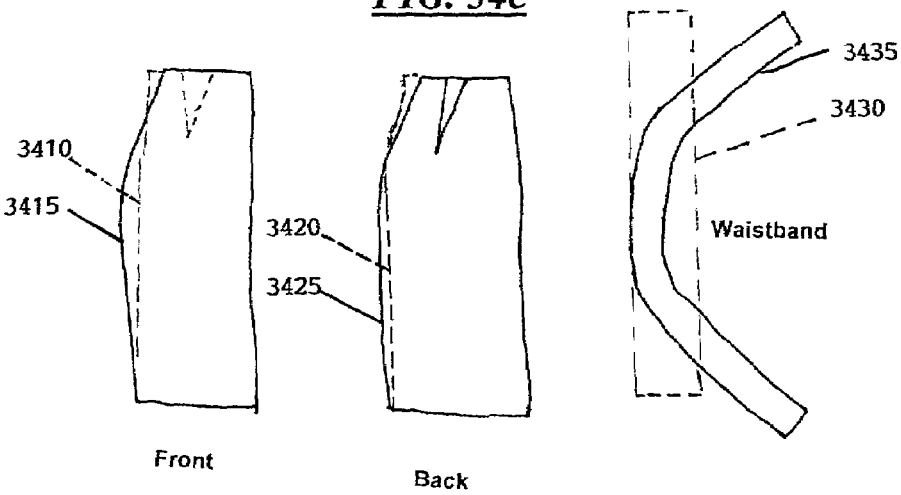

FIG. 34*c* is a composite of a skirt pattern, contrasting industry-standard pattern pieces and Black body pattern pieces of FIGS. 34*a*3 and 34*b*3.

FIG. 35*a*1 is a front elevation view of an industry-standard female pant.

FIG. 35*a*2 is a plan view of the pattern pieces of the industry-standard pant of FIG. 35*a*1.

FIG. 35*b*1 is a front elevation view of a Black body type female pant.

FIG. 35*b*2 is a plan view of the pattern pieces of the Black body pant of FIG. 35*b*1.

FIG. 36*a*1 is a front elevation view of an industry-standard male pant.

FIG. 36*a*2 is a plan view of the pattern pieces of the industry-standard pant of FIG. 36*a*1.

FIG. 36*b*1 is a front elevation view of a Black body male pant.

FIG. 36*b*2 is a plan view of the pattern pieces of the Black body pant of FIG. 36*b*1.

Figure 36C:
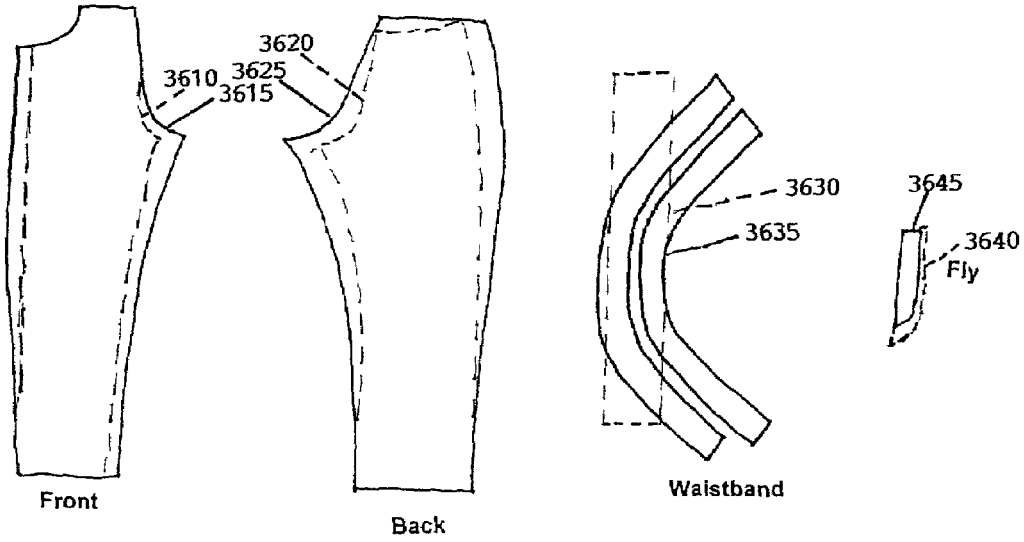

FIG. 36*c* is a composite of a male pant pattern, contrasting industry-standard pattern pieces and Black body pattern pieces of FIGS. 36*a*2 and 36*b*2.

DETAILED DESCRIPTION OF THE INVENTION

With the premises of the invention described above, herein below is a description of how the premised techniques relate to the present invention. In order that the present invention may be easily understood and readily carried into effect, provided are definitions, examples and detailed descriptions of FIGS. that include measurements, ratios, proportions, dimensions, body landmark placements and conclusions derived after obtaining empirical data in order to illustrate the invention and aspects thereof.

Definitions

The following definitions offer a foundation for the present invention without departing from the scope of the present invention.

The term "apparel" is used to refer to, and interchangeably with, articles of clothing, garments and other items worn on or applied to the human body for protection or ornamentation.

The term "physique" refers to the structure and development of the human body.

The term "Black human body is used as an example of a selected human body physique type. "Black human body" is used essentially to demonstrate that there does exist a group of the humans of African or combinations of with African decent, who have in common, distinctive physical characteristics that contrast the physique patterned in the industry-standard body. The term "Black body" is intended to include, in particular, any suitable human whose body generally incorporates certain body part measurements, dimensions, ratios, proportions, bone placements, curvatures and contours according to the patterning system and method of the present invention. The terms "Black human body", "Black body", and "Black" are used interchangeably. See FIGS. 1*a*–7.

The term "body landmark(s)" is used to refer to key locations and horizontal points on the human body that may be bones or flesh. Measurements of body landmarks provide quantitative sizing and design information. Body landmarks include, while not limited to, head, forehead, face, nose, neck, shoulder, arm, wrist, digits (fingers), bust (of women), chest (of men and children), torso, waist, crotch, hip, thigh, knee, calf, leg, neck, thigh, ankle, foot, and foot digits (toes). Often a body landmark is used in combination and in conjunction with one or more other body landmark(s) to develop composite information regarding a selected body type. Each body landmark has at least one body landmark measurement and at least one ethnicity solution. The terms "body landmark(s)", "landmark(s)" and "landmark point(s)" are used interchangeably.

The term "White" refers to the race of Caucasian humans.

The term "body type" is used in a broad sense in this specification and claims to refer to a group of humans, within the same human body physique, who have in common distinctive surface shapes. For example, terms such as "pear-shaped" "hour glass" and "boxy" denote certain body types. However, although the surface shapes are different, within the same human body physique category, the body types have in common certain body landmark measurements, dimensions, ratios and proportions, bone placements, curvatures and contours.

The term "ethnicity" is used in this specification and claims to refer to a classification of a heterogeneous human population as distinguished by same body-structural physical characteristics.

The term "ethnicity solution(s)" is used to refer to specifically to one or more of the dimensions, ratios, proportions, curvatures, positioning, depth and sloping of one or more body landmarks. Body landmark measurements and ethnicity solutions conjunctively provide for a most composite representation of a body physique. Because of the non-uniformity of bone structure and bone size, as well as fat and muscle distribution, on various body types, the body height measurement and weight, even in combination with a body landmark measurement, provide insufficient information to develop an adequately representative patterning system for a selected body. Examples of ethnicity solutions include, while not limited to, head shape, forehead shape, chest length in proportion to body height, leg length in proportion to body height, leg length in proportion to chest length, waist position relative to navel, sloping of waistline, position of buttock relative to waistline, the longitudinal curvilinear side profile across the distance from the rib cage floating bone to the top of the hip bone, the longitudinal curvilinear thigh profile, thigh mass in proportion to body mass, thigh mass in proportion to body height, digit length in proportion to palm length, width of foot in proportion to foot length, foot digit length in proportion to foot length, width of lips, width of nose, height of nose in proportion to width of nose, and degree of slope of shoulder blade. An ethnicity solution functions to correlatively connects body land marks by appreciating differences in bone structure, body part positioning, propensity and distribution of muscle and fat mass, all based on body type. An ethnicity solution may be based on a body landmark measurement or a combination of body landmark measurements, such combinations yielding ratios, proportions and scales, and permit the inference of additional ratios, proportions and scales. The terms" ethnicity solution(s)", "Black ethnicity solution(s)" and "ethnic solution(s)" may be used interchangeably. See FIGS. 33*a*, 33*b*, 34*c*, 36*c* and 25.

The term "face length" is used to refer to the distance of the vertical dimension of the human face from a center point on the head immediately adjacent and below the hairline to the lower peripheral of the chin.

The term "floating bone" is used in the anatomical sense to refer to the lowest two ribs of the human body rib cage.

The term "industry-standard" is used as a noun and adjective to refer to dimensions, ratios, proportions and placement of body parts of White, volunteer subjects, collected in 1941 and used as standard data for all pattern making, other bodily applications used for protection or ornamentation in North America. The descriptions of the Black body not rely on the industry-standard. Rather, any reference to the industry-standard in the specification and claims exists merely as a familiar control marker for comparison. The terms "industry-standard" ("I-S"), "industry-standard" ("IS") and "standard" are used interchangeably. See FIGS. 33*a*, 33*b*, 34*c* and 36*c*.

The term "lip width" is used to refer to the vertical length of the widest section of the combined upper lip and lower lip. See FIG. 12*b*.

The "mass" is used to refer to the quantity of matter forming a body; the term "mass" and "mass measurement", "body weight" and "weight" are used interchangeably.

The term "palm width" is used to refer to the horizontal distance from palm at bottom of thumb, across to palm at the bottom of pinky (last) finger.

The term "palm length" is used to refer to the vertical distance from the intersection of the digits and the palm to the wrist at the top of the carpal. The terms "palm length" and "palm size", "hand length" and "hand size" are used interchangeably.

The term "proportion" is used to refer to the division of a total area into space relationships.

The term "scale" is used to refer to size relationships that separate areas of the body have to each other.

The terms "shoulder(s)" and "shoulder blade(s)" may be used interchangeably. See FIGS. 13*a*–*b*.

The term "underpant(s)" is used throughout this specification and claims as reference to apparel items of short pants and may include panties, diapers, briefs, long johns, bathing suits, athletic pant wear extending a length generally from the waist or hip area, to above the knee area or lower and any other undergarments.

The terms "waist" and "waistline" may be used interchangeably. See FIGS. 14*a*–*b*.

The term "waist height" is used to refer to the vertical length from the waistline to the floor. See FIGS. 1*a*–2*b*.

Description/Embodiments

In order that the present invention may be easily understood and readily carried into effect, the following examples illustrate the present invention and aspects thereof. The patterning system of the present invention is for the Black human body physique. Within this disclosure, the human body physique selected by way of example is the Black human body. As well, the industry-standard body type and the Black body are frequently contrasted in order to demonstrate the problems solved by the patterning system of the present invention. Notwithstanding, it will be readily apparent to one skilled in the art that other selected human body physiques, and combinations of body physiques and body types, may benefit from this invention. The described embodiments are intended to illustrate the principles of the present invention, and not to limit the scope of the present invention. Various other embodiments, modifications to these embodiments and electronic methods of effecting this patterning system may be produced by those skilled in the art without departing from the scope of the present invention.

Referring to FIGS. 1*a*–7, distinctions in the profile of an industry-standard body and a Black body are indicated when controlling for gender, chest/bust measurement, height measurement and weight. Some body landmark height distinctions demonstrated in FIGS. 1*a*–*b* and FIGS. 2*a*–*b* are neck, bust, front waist, hip of Black body type versus the upper-hip and lower-hip of the industry-standard, crotch and knee. Information conveyed in the profiles of FIG. 1 and FIG. 2 is quantified in FIGS. 3–7. In FIG. 3, detailed height ratios are presented for females and males. FIG. 4 provides bust-waist-hip proportions for women of the Black body. FIG. 5 provides bust-waist-hip proportions for men of the Black body. FIG. 6 outlines women's rise ratios, both front rise and the back rise, and FIG. 7 outlines the front rise and the Black back rise of men.

FIGS. 1*a*–7 indicate that, in the absence of knowledge of human body physique or an ethnicity solution which is human body specific, controlling for gender, body height measurement and weight, results in an inadequate description of the physique of a human body. A designer of fitted apparel may well benefit from the patterning system of the present invention for a Black body based on ethnicity solutions.

In an embodiment of the present invention, the body height measurement and weight of a Black body is obtained. Gender may or may not be relevant for the particular pattern being developed. An ethnicity solution for the selected body is determined. The Black ethnicity solution adds an additional feature of the selected body to the patterning system. The height, weight and ethnicity solution for the Black body are combined, correlatively assembled and recorded on a patterning surface. While not always necessary, in many embodiments of the present invention, determination of one or more body landmark measurements may be helpful.

EXAMPLE 1

Head

The cranium is a body part analyzed in terms of a Black body and an ethnicity solution. According to forensic studies, individuals with a Black body have a smaller skull than the industry-standard. More than a difference in size, a Black body solution informs that there is a difference in the distribution of cranial mass whereby the Black body the has a smaller head and a greater depth from the top of the head to the bottom of the forehead, relative to the industry-standard body. It is not uncommon for a man with a Black body to bend the brim of his hat or cap in an effort to reshape the hat, enabling the hat to more adequately cup the head.

As indicated in FIGS. 9*a*–10*b*3, conventionally, baseball caps are patterned wide and not sufficiently deep for the Black body. Bending the bill (visor) of the cap alters the dynamics of the cap. The goal of the hat or cap wearer is not necessarily to achieve a certain appearance as it may be to merely hold the hat on the head. FIGS. 9*a* and 9*b* contrast the length of panels 1010, and 1015 on the two selected bodies. Rather than a wide brimmed hat or cap as with the industry-standard with short panels 1010 and a wide bill 1020, a Black ethnicity solution takes into consideration that the head of a Black body requires long panels 1015 and a narrow bill 1025 for a more narrow brow line and a deeper cut cap or hat that accommodates a head that is deep from the top of the head to the bottom of the forehead.

EXAMPLE 2

Nose/lips

Referring to FIGS. 1*a*–12*b*, the Black body has a broader nose bridge, broader nostrils and lower nostrils than the industry-standard body. The Baylor College of Medicine Institutional Review Board approved a study that supports this declaration. The study states: "The most notable differences found in measurements of Caucasian and African-American female noses included nose width nasal root width, the length of the fleshy lower part of the nasal septum, nasal bridge inclination, and the angle between the nose and the upper lip." The study concluded, "The differences found between Caucasian and African-American women, and the variablility within the latter group, suggests that new standards be adopted for nasal analysis." (A New Guide Developed for Nasal Analysis of African-American Women, 2001, published by the American Academy of Otolaryngology-Head and Neck Surgery) With the Black body, eyewear tends to be awkward and sometimes painful. Eyewear for the Black body frequently requires more adjustments and results in more skin damage where the eyewear comes in contact with the face and head.

Individuals with a Black body have fuller (wider/thicker) lips than individuals who conform to the industry-standard body. Therefore, apparel and other items applied to the Black body benefit from the patterning system of the present invention.

EXAMPLE 3

Neck

Referring to FIGS. 8*a*–8*b*, the neck of an individual with a Black body is generally more upright than is taken into account with the industry-standard shoulder measurements. When a Black body wears an industry-standard proportioned article of clothing having a collar or in contact with the neck, such as the shirt of FIGS. 29*a*–29*a*3, the clothing pushes the neck forward and causes tension on the neck and head. The clothing does not lie properly on the Black body because most garments of industry-standard cut allow for a curved or forward neckline. The contrast in need is most observable in the industry-standard collar 2910 of FIGS. 29*a*1–29*a*3 and the Black body the collar 2915 of FIGS. 29*b*1–29*b*3.

EXAMPLE 4

Shoulders

Referring to FIGS. 13*a* and 13*b*, the degree of shoulder slope for the Black body the is significantly different from that of the industry-standard. First, the Black body has a steeper shoulder slope than the industry-standard. Second, the Black Black body the shoulder has a width that is broader than the industry-standard allows. Third, the shoulder blades on the Black body tend to be shorter than the industry-standard. Thus, an industry-standard garment draped on the shoulder of the Black body displays the feature of "hanging-off" or "being too big". An industry-standard garment of sufficient size to fit properly at the Black body neck is unlikely to fit properly at the top of the Black body arm. Garment material may droop at the intersection of the shoulder and the arm and cause folds of fabric or other material to form under the arm and along the armhole seams. The appropriate Black ethnicity solutions addressing the stated problems are disclosed in FIGS. 29*b*1–29*b*3.

EXAMPLE 5

Arms/Legs

The Black human body has longer arms and legs in comparison to the industry-standard, as illustrated at FIGS. 14*a* and 14*b*. Jose Antonio, PhD and Chris Street, MS writes in Testosterone publication, June of 1998. "The legth of the upper and lower extremities between blacks, whites, and Asians is obviously different to anyone of 20/20 vision. Asians (East Asians: Chinese, Japanese. Vietnamese) tend to be smaller with relatively short extremities and long torsos. Blacks tend to have relatively long extremities with short torsos and whites are somewhere in between. As early as 1939, it has been reported that as a group, blacks tend to have longer arms and legs (as a percentage of height), narrower hips, and more slender calves than whites. According to noted scientist Robert Malina, "black youth have absolutely and relatively longer lower extremities than Mexican-American and white youth."

It may be surmised that because of the relatively shorter shoulder, the arm length is sufficient. While there may be sufficient fabric or other material in the apparel item, the problem is the distribution of the material across the apparel item. This longer arm length of the Black body in comparison to the industry-standard is demonstrated in the shirts of FIGS. 29*a*1–29*b*3.

EXAMPLE 6

Chest

The chest circumference is measured from the fullest point of the chest by measuring over the shoulder blades, under the arms and across the chest apex. The chest circumference of the Black body is narrower than that of the industry-standard, yet of greater depth (thickness/width) than the industry-standard. The distance of the chest from the shoulder to the waistline is shorter on the Black body than the industry-standard. That is, the Black body chest is higher in position (closer to the shoulder) than the industry-standard placement of the chest. Jackets and shirts manufactured from an industry-standard men's pattern that provides adequate covering for the Black body arm tend to have elongated chests and over-sized armholes when worn by men with the Black body, in comparison to the modeled men intended for wear of these industry-standard patterned garments. The Black body must purchase garments of sufficient arm length, and that means purchasing garments that are sized with excessive chest width and excessive shoulder width. Men with the Black body must purchase larger industry-standard sizes than are actually required by certain parts of their body in order to obtain comfortable fit.

There are several ethnicity solutions in this instance for the Black human body Industry-standard patterns for apparel which covers the chest, including, but not limited to, jackets, coats and shirts, requires altering in the following ways: 1) reducing the neck slope to prevent apparel from riding up the neck; 2) raise the height of the chest; 3) shorten the length of the shoulder; 4) shorten the length of the armhole; 5) lengthen the arm; 6) raise the waistline and 7) shorten the waist circumference.

FIGS. 4 and 5 indicate a distinct relationship between the chest-waist-hip measurements of the Black body that differs from the distinct relationship between the chest-waist-hip measurements of the industry-standard. According to the information for males in FIG. 5, chest-waist-hip bears the ratios of 1.00×: 0.80×:1.01× with a tolerance range of 10%, such that incorporation of the tolerance range results in the ratio of 1:00×:0.08×(+/−0.10): 1.01×(+(+/−0.10 and are embodied in FIGS. 29*b*1–3 and 36*b*1–3. These relationships are investigated further in FIGS. 4 and 15 for females and embodied in, for examples, FIGS. 26, 34*b*1–3 and 35*b*1–2.

EXAMPLE 7

Bust

The distance from the shoulder to the bust on the Black body is shorter, meaning higher in position than is provided for in FIG. 27*a* depicting an industry-standard pattern. As shown in FIG. 30*a*, conventional bust darts, according to the industry-standard blouses are misplaced for persons of the Black body. The industry-standard misplaced bust darts make for a less tapered bust fit than desired. Princess darts of the industry-standard pattern are insufficiently tapered for a person of the Black body. Again referring to FIG. 27*a*, a brassieres and swimsuits made from industry-standard patterns have straps that are too long, even when shortened to capacity. The results are a lack of adequate support for the breast in brassieres and ill-fitting swimsuits. The problems cited in this section on Bust carryover into all upper body apparel for women with the Black body.

FIG. 27*b* and FIG. 30*b* disclose that there are several upper body ethnicity solutions for the Black body. In FIG. 30*b*, the darts 3015 in upper body apparel for women are slightly higher and princess darts are more tapered than the industry-standard darts 3010 of FIG. 30*a*. IN FIGS. 30*b*, the waist 3055 is adjusted to the Black body in contrast to the industry-standard waist 3050. As indicated in FIG. 27*b*, straps 2725 for the Black body on, including but not limited to, brassieres, slips, camisoles, t-shirts, swimsuits, gymnastic wear and other athletic wear, are shorter or adjustable at least an inch more so than the industry-standard straps 2720 of FIG. 27*a* and FIG. 30*a*. Further comparison to the industry-standard brassiere of FIG. 27*a*, in FIG. 27*b*, the Black body brassiere has a wider cup section 2730 in the underarm direction than the industry-standard cup section 2735 in order to provide for a fuller breast dimension and the center band 2755 is at least of 10% less width than the industry-standard center band 2750 such that the straps are closer one to another.

EXAMPLE 8

Waist

Referring to FIGS. 3 and 34*a*–35*b*, given an industry-standard body and a Black body when controlling for gender, age, height and weight, the Black body has a narrower waist than the industry-standard body. Also, the industry-standard waist is concave and planar from center back to center-front at the navel: it does not tilt. As an ethnicity solution, the Black body waist may be described as curved from center back and sloping downward to center-front approximately 1.0 to 2.0 inches below the navel, with the greatest percentage of the 1.0 to 2.0 inches of sloping occurring across the front of the body.

EXAMPLE 9

Torso

Referring to FIGS. 15*a* and 15*b*, the torso measurement is the vertical circumference the body from the mid-point on the shoulder down passing through the crotch and back up to the mid-point on the shoulder. The mid-point on the shoulder is located halfway between the highpoint of the shoulder and the shoulder point. The highpoint of the shoulder refers to the point where the shoulder meets the neck at the base on the side of the neck and the shoulder point refers to the point where the shoulder meets the arm socket. The Black body generally has a shorter torso than tat what is present for the industry-standard pattern. The torso measurement offers insight into the compactness or protraction of ethnicity solutions. The torso measurement in combination with a body landmark measurement may reveal a number of Black ethnicity solutions.

EXAMPLE 10

Buttock/Hip/Thigh

There are several distinctions, and thus ethnicity solutions, in the buttock/hip/thigh area. Referring to FIGS. 1*a* and 1*b*, the distance from the waist to the knee is longer on the Black body in comparison to the industry-standard body. FIG. 1*a* indicates that the industry-standard body, unlike the Black body, has an upper hip-lower hip combination that is, some what of a trapezoid-shaped hip area. By contrast to the industry-standard buttock/hip area, which begins approximately 1.5 to 3.0 inches below the waist, FIGS. 1, 2 and 26 illustrate that the buttock/hip area on the Black body type displays distinct curvature beginning at the lowest point on the waist. The widest portion of a hip is the position where the circumference of the hip is measured. FIGS. 1, 2 and 26 further illustrate that circumference of the hip is positioned closer to the waistline on the Black body than on the industry-standard of FIGS. 1 and 2. Referring to FIGS. 4 and 5, the Black body waist-hip ratio is more distinguishing than the waist-hip ratio of the industry-standard body. The Black body has a fuller (in depth) buttock than is provided in the industry-standard patterning system.

Referring to FIGS. 16*a*–18*b*, 26, 35*b*1–2, 36*b*1–2 and 36*c* the Black body displays fuller buttocks and fuller thighs, particularly where the thighbone fits the hip socket. This fuller Black body thigh seems to be attributable to increased muscle mass over the industry-standard body, which may help to explain the increased curvature. Many sewing books and fashion designing houses refer to the presence of a large buttock as a body "figure flaw". The relatively large buttock of the Black body type is significantly attributable to protruding hipbones, and also a propensity for fat and/or muscle accumulation in the buttock area.

Reviewing undergarment apparel, undergarments manufactured from industry-standard patterns do not fit the Black body correctly. Panties, as well as other fitted underpants of the industry-standard body type, do not fit the Black body. The industry-standard panties intended to provide full coverage of the gluteus, which are of a non-bloomer design, do not provide full coverage of the gluteus of the Black body. Lack of full coverage produces unsightly panty lines and the discomfort of panty bunching.

At FIGS. 16*a*–18*b* and 32*a*–32*b*, in several embodiments of the present invention utilizing the example of the Black body, and in contrast to the industry-standard body, the Black body panty has a lower front waist, lower leg cutout and fuller back bottom based on the ethnicity solutions of the present invention.

Men of the Black body must purchase industry-standard underwear several sizes larger than required by their waistline in order to get a comfortable fit in the buttocks and the crotch area. Because comfort in the buttock, crotch and thigh areas is primary, men of the Black body usually sacrifice waistline fit. It is correct for men who fit the industry-standard to review the sizing chart on the package and purchase accord to waist measurement. When men of the Black back body type make the mistake of purchasing underwear according to waist measurement, the underwear is too tight in the crotch and buttocks areas and can frequently lead to medical problems.

The fullest part of the gluteus on the Black body is stuffed in a narrow part of the industry-standard pant. This situation gives the appearance of an exaggerated bubble-shaped gluteus. These problems carryover to skirts, pantyhose, tights, diapers, training pants, and other items that fit a Black body in the buttock/hip/thigh areas.

There are ethnicity solutions for the Black body. Industry-standard fitted underpants patterns are amended to accommodate the Black body when the distance in the crotch is shortened such that the underpants fit on the waist of the Black and the pattern is reshaped for a fuller, more curved gluteus.

EXAMPLE 11

Diapers/Training Pants

To facilitate the physical health and comfort of diapers, air must circulate into the body landmark areas covered by a diaper. Referring to FIGS. 19*a* and 21*a* which compare the industry-standard diaper to a Black body diaper according to the product and methods of the present invention, the industry-standard diaper that fits a baby according to the weight sizing chart on diaper packaging has a crotch 1940 that is too wide between baby's legs, which causes baby to have problems bringing legs together for balance when learning to stand and walk. The industry-standard diaper front waist 1910 sits too high on a Black baby, causing poor air circulation and rubbing against the widest part of baby's waist rather than the narrowest part of baby's waist. The industry-standard diaper back waist 1920 is also too high on the Black body. FIG. 19*b* illustrates how the back bottom 1930 of the industry-standard diaper lies flat on the Black body, which can make bowel movement difficult. In the embodiment of the present invention at FIG. 22, the front waistband is fitted at the Black body waist and there is curvature at the diaper back bottom 1935 relative to the flat back bottom 1930 of the industry-standard at FIGS. 19*a* and 19*b*. The diaper for the Black body at FIGS. 22 and 23 are patterned with ethnicity solutions in a manner such that the diaper front waist 1915 is fitted and the leg cutout 1955 is positioned sufficiently below the widest section of the hip of the Black body according to FIG. 20 to permit the leg cutout 1955 to resist rising above the widest section of the hip when the diaper is worn. The leg cut out 1955 is patterned in a manner such that the leg cutout 1955 is properly sized for the Black body and not cocking under the buttock area, thereby avoiding poor blood and air circulation, particularly when a diaper contains an elasticized material. Again referring to FIG. 22, the back waist 1925 is low and the crotch 1945 is narrow and shorter.

EXAMPLE 12

Crotch-Rise (Front Rise/Back Rise)

Referring to FIGS. 6 and 7, the crotch-rise measurement is another example of the distinctions in the industry-standard and the present patterning system that factors in ethnicity solutions. Certain crotch-rise measurements for the Black body are compared to the industry-standard in FIGS. 6 and 7. Rise is defined as length from the center front waistline, down between and/or through the legs, following the body's natural curve, to the waistline at the center back. Front rise refers to the length from the center front waistline, down to the end of the front crotch, where front pant meets back pant. Back rise refers to the length from the center back waistline, down through the legs, around the natural curve of the gluteus, to the point where the back pant meets the front pant. For each size, an average front rise and back rise measurement is listed for the Black body type and the industry-standard body. FIG. 6 is representative of particular measurements for women. The total rise length is equal to the sum of the front rise measurement and the back rise measurement. The front rise for women of the Black body is 44–49% of the back rise for women of the Black body, with the highest percentages being representative of the largest Black body sizes in FIG. 6. In FIG. 6, the Black body front rise for women is 31–33% of the total rise length. In this same FIG. 6, the industry-standard front rise for women is 72–76% of the industry-standard back rise for women, with the highest percentages being representative of the largest industry-standard sizes in FIG. 6. In FIG. 6, the industry-standard front rise for women is 42–43% of the total rise length. Additionally, in FIG. 6, the total rise length for women considered comporting to the Black body is 96–97% of the industry-standard total rise length, with the smallest Black body having the largest percentages.

Very similar distribution percentages for men are reflected in FIG. 7, which compares measurements for the Black body and the industry-standard. Referring to FIGS. 36*a*, 36*b* and 36*c*, the patterning pieces are designed for a male pant upon utilizing the measurement charts of FIGS. 4, 5 and 7 that take into consideration Black ethnicity solutions. While patterning system for the Black body type need be as extensive as FIGS. 36*b* and 36*c*, each of the patterning pieces 3615, 3625, 3635, 3645 embodies at least one ethnicity solution disclosed hereinabove in this description. The description of the Black body pant in FIGS. 36*b* and 36*c* are in comparison to the industry-standard male pant in FIGS. 36*a* and 36*c*. The Black body pant leg front 3615 embodies the ethnicity solutions of a shorter, narrower crotch area. In addition, the pant leg back 3625 embodies the Black ethnicity solution of a broader buttock area and a larger thigh area. The Black body pant waistband 3635 embodies the Black ethnicity solution of a sloping or tilted waist. The Black body pant fly 3645 is shorter in order to reflect a shorter crotch area.

EXAMPLE 13

Calves

The Black body a smaller calf circumference, in proportion to its thigh, than the industry-standard.

EXAMPLE 14

Digits/Foot Digits

FIGS. 24*a* and 24*b* demonstrate that the Black body tends to have longer digits than the industry-standard body type. A Black body hand with a palm sized similar to an industry-standard palm will tend to display digits that are longer than those digits measured for on the industry-standard pattern for a particular sized palm. FIG. 25 shows gloves manufactured for the industry-standard body type do not take into account the Black body digit length and, as a result, the digit casings are of insufficient length and the industry-standard glove of insufficient length prevents range of motion in the wrist and in the root of the fingers for the Black body. When such ill-fitted occupational gloves are worn a prolonged period of time on a regular basis, serious problems of arthritis and hand cramping may occur. In industry-standard patterned gloves that have adequate digit length for the Black body, the wrist section of the glove tends to be over-sized. In an embodiment of the present invention, the digit casings on an industry-standard glove are modified to extend at least an additional 0.75 inches. This modification to the industry-standard pattern is valid for gloves for cold weather, fashion, riding, batting and safety protection. In industrial and construction occupations where gloves are worn for safety, preventing range of motion in the wrist and in the root of the fingers creates an unsafe environment.

The Black body type may be characterized as having a wide foot relative to the length of the foot, and foot digits (toes) are longer than those on the industry-standard foot of similar length.

EXAMPLE 15

Three-dimensional Patterning

In optional embodiments of the present invention, the patterning surface is a mannequin, an apparel form or similar three-dimensional surface within the scope of the present invention. The patterning surface of FIG. 26 is three-dimensionally shaped to represent Black ethnicity solutions in order to form the patterning system.

ADDITIONAL EXAMPLES

FIGS. 10*a*1–10*b*3 and 28*a*–36*b* jointly demonstrate industry-standard patterns and the effects of adding ethnicity solutions for the Black body to an industry-standard pattern. FIGS. 33*a*, 33*b*, 34*c*, and 36*c* disclose embodiments of the present invention wherein the industry-standard and the Black body are applied in a respective manner to the patterning surface. Different human body physiques may be applied to the patterning surface in contrasting colors in order to make the distinctions, such as the body physiques contrasts of FIGS. 33*a*, 33*b*, 34*c* and 36*c*, most observable.

It is intended that the scope of the invention should cover a patterning system whenever an item is prepared by use or reference to a product or by a method as disclosed and claimed therein. The foregoing disclosure has been set forth merely to illustrate the invention and is not intended to be limiting. Since modifications of the disclosed embodiments incorporating the spirit and substance of the invention may occur to persons skilled in art, the invention should be construed to include everything within the scope of the appended claims and equivalents thereof.

What is claimed is:

1. A patterning system to accommodate a specific human selected body physique type, comprising:

a specific selected body type for a selected gender;

a height measurement for said specific selected body type;

a weight measurement for said specific selected body type;

a body landmark measurement for said specific human body type;

an ethnicity solution to add a distinctive feature of said specific human selected body type to said patterning system;

a patterning surface upon which said height, weight, body landmarks measurements and ethnicity solution are combined and correlatively assembled for said selected body type to thereby form said patterning system;

wherein the ethnicity solution compensates for chest circumference, waist circumference, and hip circumference by incorporating an ethnicity solution ratio defined as 1.00×:0.80×:1.01× respectively, with a tolerance range of ±10×, and used to calculate particular body landmarks measurements when only one body landmark measurement is known and compensates for bone structure and muscle propensity distribution for said body landmark measurements, not considered by previous industry standards, which are characteristic and distinctive of said specific selected body type and is used in combination with the height and weight measurements to form said patterning system.

2. The patterning system of claim 1, wherein said body landmark is selected from the group of body parts consisting of ankle, arm, bust, buttock, chest, cross torso, crotch, finger length, forehead, hand, head, hip, knee, leg length, neck, thigh, and waist.

3. The patterning system of claim 1, wherein the specific ethnicity solution is selected from the group consisting of shape of head, chest length in comparison to body height measurement, arm length, leg length in proportion to body height measurement, leg length in proportion to chest length, waist position relative to navel, location of waistline, position of buttock relative to waistline, side vertical curvature across distance between rib cage floating rib and hip bone outer periphery, curvature of thigh mass, finger length in proportion to hand length, width of foot in proportion to foot length, length of foot digits in proportion to length of foot, width of lips in proportion to face length, width of nose in proportion to two-dimensional face length, nose height and sloping shoulder blades.

4. The patterning system of claim 1, wherein the patterning surface is selected from the group consisting of cloth, felt, plastic, vinyl, opaque paper, generally transparent paper, tissue paper, erasable paper, paper board foam and metal.

5. The patterning system of claim 1, wherein the patterning surface is a generally planar surface.

6. The patterning system of claim 1, wherein the patterning surface is a three-dimensional form.

7. The patterning system of claim 1, wherein the patterning surface is a mannequin with a specific human body physique.

8. The patterning system of claim 1, wherein the specific ethnicity solution being distance between waistline and buttock.

9. The patterning system of claim 1, wherein the specific ethnicity solution on the patterning surface is respective and comparable for at least two selected human body physiques types.

10. A pant patterning system for a specific human selected body type, comprising:

height measurement for said specific selected body type;

weight measurement for said specific selected body type;

an ethnicity solution to add a distinctive feature of said specific human selected body type to said patterning system;

a patterning surface upon which said height, weight, body landmarks measurements and ethnicity solution are combined, recorded and correlatively assembled for said selected body type to thereby form said patterning system that compensates for body depth, body thickness and body width in compliance with an ethnicity solution ratio;

wherein the ethnicity solution compensates for chest circumference, waist circumference, and hip circumference by incorporating an ethnicity solution ratio defined as 1.00×:0.80×:1.01× and used in combination with the height and weight measurements to calculate a particular body landmark measurement and compensates for specific human body structures and density of muscles not considered by previous industry standards, which are characteristic and distinctive of said specific selected body type and is used in combination with the height and weight measurements to form said pant patterning system.

11. A patterning system for a specific human selected body physique type, comprising:

selecting a body type;

ascertaining a height measurement for said body type in order to provide a first body type variable for said body type;

ascertaining a weight measurement for said body type in order to provide a second body type variable for said body type;

determining a body landmark measurement for said body type;

ascertaining a measurement for said body landmark in order to provide a third body type variable for said body type;

ascertaining an ethnicity solution in combination with said first body type variable, said second body type variable and said third body type variable in order to add a distinctive feature of said specific human selected body type to said patterning system;

wherein the ethnicity solution compensates for chest circumference, waist circumference, and hip circumference by incorporating an ethnicity solution ratio defined as 1.00×:0.80×:1.01× respectively, with a tolerance range of ±0.10×, and used to calculate particular body landmarks measurements when only one body landmark measurement is known and compensates for bone structure and muscle propensity distribution for said body landmark measurements, not considered by previous industry standards, which are characteristic and distinctive of said specific selected body type and is used in combination with the height and weight measurements to form said patterning system;

providing a patterning surface;

applying said ethnicity solution and body type variables to said patterning surface correlatively to thereby form said patterning system.

12. The patterning system of claim 11, wherein said patterning surface is an industry standard patterning modified according to said patterning system to accommodate said specific selected body type.

13. The patterning system of claim 11, wherein said patterning surface further comprising of an industry-standard pattern applied to said patterning surface in respective manner.

14. A patterning system to accommodate a specific human selected body type, said patterning system comprising:

selecting a body type;

selecting a body landmark for said selected body type;

determining a body landmark measurement for said body landmark of said selected body type;

ascertaining an ethnicity solution for said body landmark;

wherein the ethnicity solution compensates for chest circumference, waist circumference, and hip circumference by incorporating an ethnicity solution ratio defined as 1.00×:0.80×:1.01×, respectively, with a tolerance range of ±0.10×, and used to calculate particular body landmarks measurements when only one body landmark measurement is known and compensates for bone structure and muscle propensity distribution for said body landmark measurements, not considered by previous industry standards, which are characteristic and distinctive of said specific selected body type and is used in combination with the height and weight measurements to form said patterning system;

providing a patterning surface;

applying said body landmark measurement and said ethnicity solution to said patterning surface correlatively; and forming said patterning system for said selected body type.

15. The patterning system of claim 14, wherein the ethnicity solution is selected from the specific body group, consisting of shape of head, chest length in proportion to body height measurement, leg length in proportion to body height measurement, leg length in proportion to chest length, waist proportion relative to navel, location to waistline, position of buttock relative to outer periphery, natural spinal curvature in groove of back, curvature of thigh mass, finger length in proportion to hand length where palm width in proportion to middle finger length is 1.40×:×, width of foot in proportion to foot length, length of foot digits in proportion to length and width of foot, where foot width in proportion to "big toe" (first toe) length and last toe length, where the ratio is 2×:×:0.5× respectively, with tolerance of +/−0.40 for foot width and +/−0.25 for last toe; width of lips in proportion to face length, width of nose in proportion to two-dimensional face length, nose height and sloping shoulder blades; wherein the ratio of foot width in proportion to "big toe" (first toe) length and last toe length 2×:×:0.5× can be applied to the making of footwear, including but not limited to socks, shoes, boots, and stockings for a specific human body; and wherein if the specific human body is an African (Black) European of African descent, the ratio could be used to figure out foot proportions; and wherein simple algebra concludes that if the "big toes" is 2 inches long, the total ratio is 4 inches:2 inches: 1 inch, with a tolerance range of plus or minus 0.40 for the foot width and plus or minus 0.25 for the length of the last toe.

16. The patterning system of claim 14, wherein the patterning surface is selected from the group consisting of cloth, felt, plastic, vinyl, opaque paper, generally transparent paper, tissue paper, erasable paper, paper board foam and metal.

17. The patterning system of claim 14, wherein the patterning system surface is a generally planar surface.

18. The patterning system of claim 14, wherein the patterning surface is a three-dimensional form.

19. The patterning system of claim 14, wherein the patterning surface is a specific body mannequin.

20. A method of preparing a patterning system to accommodate a selected body type; comprising the steps of:

selecting a height measurement for said selected body type;

selecting a weight for said selected body type;

ascertaining a body landmark measurement for a selected body landmark of said selected body type;

determining an ethnicity solution for said body landmark in order to add an additional feature to said selected body type;

wherein the ethnicity solution compensates for chest circumference, waist circumference, and hip circumference by incorporating an ethnicity solution ratio defined as 1.00×:0.80×:1.01×, respectively, with a tolerance range of ±0.10×, and used to calculate particular body landmarks measurements when only one body landmark measurement is known and compensates for bone structure and muscle propensity distribution for said body landmark measurements, not considered by previous industry standards, which are characteristic and distinctive of said specific selected body type and is used in combination with the height and weight measurements to form said patterning system;

combining said height measurement, said weight measurement, said body landmark measurement and said ethnicity solution in a correlative manner in order to add a distinctive feature of said selected body type to said patterning system; and recording said correlative combination of said height measurement, said weight measurement, said body landmark measurement and said ethnicity solution on a patterning surface such that a patterning system is formed for said selected body type.

* * * * *